United States Patent [19]

Garza-Tamez

[11] Patent Number: 4,860,507

[45] Date of Patent: Aug. 29, 1989

[54] STRUCTURE STABILIZATION SYSTEM

[76] Inventor: Federico Garza-Tamez, Rio Tamesi 305 Col. Mex., Monterrey N.L., Mexico

[21] Appl. No.: 219,568

[22] Filed: Jul. 15, 1988

[51] Int. Cl.[4] ..... E02D 27/34

[52] U.S. Cl. ..... 52/167; 248/560; 248/561; 248/566; 248/573; 248/581

[58] Field of Search ..... 52/167; 248/560, 561, 248/566, 573, 581, 610

[56] References Cited

U.S. PATENT DOCUMENTS

| | | | |
|---|---|---|---|
| 1,761,321 | 6/1930 | Wells . | |
| 1,761,322 | 4/1928 | Wells . | |
| 3,110,464 | 11/1963 | Baratoff et al. . | |
| 3,129,531 | 4/1964 | Connor . | |
| 3,638,377 | 2/1972 | Caspe | 52/167 |
| 3,726,986 | 4/1973 | Higaki et al. . | |
| 3,731,898 | 5/1973 | Smith . | |
| 3,789,174 | 1/1974 | Barkan et al. . | |
| 3,977,140 | 8/1976 | Matsudaira et al. . | |
| 3,986,367 | 10/1976 | Kalpins . | |
| 4,042,651 | 8/1977 | Gaurois . | |
| 4,166,344 | 9/1979 | Ikonomon . | |
| 4,266,379 | 5/1981 | Aguilar | 52/167 |
| 4,371,143 | 2/1983 | Ishida | 248/562 |
| 4,389,141 | 6/1983 | Cumings | 52/167 |
| 4,496,130 | 1/1985 | Toyama . | |
| 4,554,767 | 11/1985 | Ikonomou | 52/167 |
| 4,574,540 | 3/1986 | Shiau | 52/167 |
| 4,587,773 | 5/1986 | Valencia | 52/167 DF |
| 4,700,932 | 10/1987 | Katsuno | 52/167 |

FOREIGN PATENT DOCUMENTS

| | | | |
|---|---|---|---|
| 872117 | 6/1971 | Canada . | |
| 915353 | 11/1972 | Canada . | |
| 0079048 | 5/1982 | European Pat. Off. | 52/167 |
| 3200815 | 7/1983 | Fed. Rep. of Germany | 248/560 |
| 376615 | 4/1973 | U.S.S.R. . | |

*Primary Examiner*—Henry E. Raduazo
*Attorney, Agent, or Firm*—Staas & Halsey

[57] ABSTRACT

A structure stabilization system for protecting structures from effects of seismic disturbances. Plural bases of a base isolation system support, through flexible suspension elements, corresponding, plural vertical support columns. Corresponding adjustment mechanisms on each base provide for adjusting all support elements to a common elevation. A gripper mechanism in each base is selectively, axially adjustable to establish substantially identical, effective free suspension lengths and common harmonic characteristics of all suspension elements. A releasable interlock subsystem interlocks the structure to the foundation to render it stable against minor forces, such as produced by wind, and automatically releases the structure to permit same to float in support by the base isolation system in response to forces exceeding a predetermined level. A damping subsystem comprises plural dampers connected in symmetrically located positions between the structure and the foundation and arranged, at a minimum, as oppositely disposed, mutually orthogonal pairs, the associated dampers of each pair being hydraulically interconnected and mechanically connected between the structure and its associated foundation in inverse relationship.

34 Claims, 10 Drawing Sheets

STRUCTURE STABILIZATION SYSTEM

BACKGROUND OF THE INVENTION

1. Field of the Invention

This invention relates to an improved structure stabilization system for protecting structures, e.g., buildings, from effects of seismic disturbances. More particularly, the present invention relates to improvements in a base isolation system employing vertical support columns suspended by flexible elements from corresponding bases and which provide "floating" support of a structure relative to its foundation, thereby minimizing horizontal movement transmission from the ground to the structure, and to releasable interlock and damping subsystems, employable independently and/or in combination with conventional base isolation systems and preferably with the improved base isolation system of the invention. The base isolation system improvements prevent unpredicted stresses from developing in the support columns and possible tendencies of the structure to rotate relatively to the foundation while assuring that a predetermined natural period of oscillation is maintained in common for all such columns and elements, and yet affording the ability to adjust the actual length of the flexible elements as to maintain a common elevation of the support column thereby compensating for variations in ground level support of the bases, unequal stretching of the flexible suspension elements, and the like. The releasable interlock subsystem provides a single interlock between the structure and its foundation which prevents translational movement of the structure relative to its foundation despite minor forces, such as caused by wind, applied to the structure but which, in response to forces exceeding a predetermined threshold such as produced by a seismic event, automatically releases the interlock and permits the structure to "float" on the support afforded by the base isolation system. The damping subsystem impedes rotation of the structure relative to its foundation, in both the engaged and released states of the releasable interlock subsystem; it furthermore reduces the acceleration response of the system and damps lateral displacement of the structure relative to its foundation when released from the releasable interlock subsystem and thus when "floating" on the base isolation system. The damping subsystem of the invention moreover may be utilized with alternative base isolation systems which permit relative vertical displacements of opposite vertical sides of a building, such as those employing elastic isolators, to impede relative rotation of the structure in a vertical plane.

2. Description of the Related Art

Structure stabilization systems for protecting structures, e.g., buildings, from the effects of seismic disturbances are known in the art. Canadian Patent No. 872,117 in the name of the common inventor herein discloses a base isolation system which functions to minimize the transmission of horizontal movement from the ground to the structure. A plurality of bases are anchored to the foundation floor, each base supporting a plurality of cables joined to the lower end of vertical support columns which directly support the structure. While the suspension of the support columns by the cables is effective to minimize horizontal movement transmission from the ground to the structure, it has been determined that certain deficiencies exist in the prior system. For example, to accommodate both height variations in the foundation floor on which the bases are anchored which may exist in the initial construction or may occur over time due to settlement and also uneven stretching of the cables, adjustment mechanisms are provided on the bases to adjust the suspension length of the cables (i.e., the length of the cables between their respective points of attachment to the base and to the support column) thereby to equalize the elevation, or height, of the support columns associated with the plural bases. The resultant, different lengths of the cables of the plural bases, however, creates corresponding, unequal harmonic characteristics of the support cables which, in the event of a seismic occurrence, can produce unpredicted stresses in the support columns and a change in the natural period of oscillation from a predetermined value intended to be provided by the base isolation system and further may present a tendency of the structure to rotate relatively to the foundation, all of which factors may contribute to potentially destructive forces imposed on the structure and the "floating" support columns. There thus is a serious need to provide improvements for overcoming these and other defects and limitations of known base isolation systems.

While base isolation systems of the type described thus permit the structure to move relatively to the foundation (and thus to the ground in which the foundation is anchored), i.e., to "float," it is desirable to inhibit that "floating" characteristic in the absence of a seismic occurrence and, instead, to maintain the structure stable against minor forces, e.g., wind. For this purpose, it has been known in the prior art to interconnect the structure and its foundation with a plurality of breakable pins or other releasable interlock mechanisms which are of sufficient integrity to withstand minor forces which are applied to the structure (e.g., wind), but which will break or release in response to forces of a greater level, such as produced by a seismic disturbance, and thereby allow the structure to "float" in accordance with the base isolation system. A critical defect, however, can arise with such prior art releasable interlock mechanisms in that if all of the breakable pins or other release mechanisms do not function simultaneously, i.e., to break or release the structure from its foundation, destructive rotations and/or gyrations of the structure may result. There thus is a need to overcome these and other critical defects of prior art releasable interlock mechanisms.

It is also known to use energy dissipation devices, or dampers, for dissipating the energy which seismic-produced forces exert on a structure. Typically, in the prior art, a plurality of independently acting shock absorbers are connected between the structure and its foundation or otherwise rigidly attached to the earth, at generally symmetrical, spaced positions and in corresponding orientations. A problem of such prior damping systems, however, arises in that the horizontal projection of the center of gravity of the building typically does not coincide with the centroid of the horizontal inertia forces opposing displacement of the structure relative to its foundation. As a result, a net force tending to rotate the building relative to its foundation may occur, introducing gyrations that produce linear displacements between the structure and its foundation, in an amount proportional to the distance from the center of rotation to the given juncture or plane of interconnection of the structure and its foundation. Moreover, such independent shock absorbers may introduce phase differential effects which contribute to gyrations or rotational oscillations of the structure. There thus is a need for improvements which overcome such defects and limitations of known damping systems.

These and other defects and inadequacies of prior art systems are overcome by the structure stabilization system of the present invention.

SUMMARY OF THE INVENTION

It is an object of the present invention to provide an improved structure stabilization system for protecting a structure from the effects of seismic disturbances.

Another object of the present invention is to provide an improved structure stabilization system for preventing a structure from rotating with respect to the ground as a result of a seismic disturbance.

An additional object of the present invention is to provide an improved structure stabilization system for minimizing inertia forces exerted upon the structure and dissipating the energy exerted upon a structure by a seismic disturbance.

A further object of the present invention is to provide an improved structure stabilization system wherein the actual suspension lengths of flexible suspension elements of a base isolation system are adjustable so as to compensate for settling or shifting of the earth's surface and/or for unequal stretching of the suspension elements, while nevertheless maintaining a common, predetermined value of the effective "free" length of all such suspension elements.

Still another object of the present invention is to provide an improved structure stabilization system having a releasable interlock subsystem for securing the structure to its foundation and thereby maintaining it substantially rigid and capable of withstanding wind without lateral movement under normal conditions, and which automatically releases in the event of a seismic disturbance which creates forces above a predetermined threshold level, thereby to permit the structure to "float" on its base isolation system for minimizing horizontal movement transmission from the ground to the structure.

Yet another object of the present invention is to provide an improved structure stabilization system comprising a base isolation system having an interlock subsystem and a damping subsystem which cooperate to maintain the structure substantially rigid and capable of withstanding normal forces, as caused by wind, without lateral and/or angular movement while being automatically activated to protect the structure in the event of a seismic disturbance which exceeds a predetermined threshold.

Still another object of the present invention is to provide improved releasable interlock and damping subsystems, each of which is employable independently and/or in combination with the other thereof, with conventional base isolation systems or, and preferably, with the improved base isolation system of the invention.

The foregoing and other objects are achieved by the improved structure stabilization system of the present invention, which, in a preferred embodiment, comprises the improved base isolation system in combination with the improved interlock and damping subsystems. Each of the improved system and subsystems hereof moreover has independent usefulness and thus each may be employed in combination with other such systems and/or subsystems. Thus, each of the damper and interlock subsystems may be employed with other base isolation systems and, alternatively, the improved base isolation system of the invention may be employed with other damper subsystems and/or interlock subsystems.

The base isolation system of the present invention is an improvement over that disclosed in the above-referenced Canadian Patent No. 872,117 and particularly includes an adjustment mechanism which maintains the identical "effective" free length of the flexible suspension support elements, or cables, thereby to maintain common harmonic characteristics, while permitting adjustment of the actual suspension lengths of the cables. Thus, the potential problems of prior art such base isolation systems wherein the "effective" free lengths of the flexible suspension elements are the same as the "actual" suspension lengths thereof, and therefor may differ, are overcome. As before-noted, the unequal harmonic characteristics of varying length support cables or other flexible elements can produce unpredicted stresses in the support columns and a change in the natural period of isolation from a predetermined value intended to be provided and, further, may present a tendency of the structure to rotate relatively to the foundation, all of which factors may contribute to potentially destructive forces imposed on the structure and the "floating" support columns.

The releasable interlock subsystem employs a single pin received in a plate integrally formed in the lowermost floor level of the structure, which prevents translational movement of the structure relative to its foundation in response to forces of ordinary levels as produced by winds. A release mechanism is responsive to forces above a predetermined threshold level, as produced by a seismic disturbance, for automatically withdrawing the pin and causing the structure to "float," as supported by the base isolation system, for minimizing the transmission of horizontal movement from the ground to the structure. In accordance with yet another feature of the invention, the single pin may be a shear pin which may fracture in response to a force exceeding a second, predetermined threshold level higher than that activating the release mechanism, as a guarantee that the release will occur should the release mechanism not be activated.

The damping subsystem employs hydraulically interconnected dampers, arranged as one or more pairs, and which are mechanically connected in inverted relationship between the structure and its foundation (or other support fixedly secured to the ground). From a functional or theoretical standpoint, it is sufficient that the dampers of a given pair be displaced by substantially equal (and preferably the maximum possible) distances and in opposite directions from the center of gravity of the building. Preferably and typically, each such pair of dampers is connected in the inverted relationship between opposing, parallel walls of the structure and the corresponding foundation walls. A single such pair of dampers, mechanically connected in inverted relationship as between the structure and its foundation and with the hydraulic interconnection of the present invention, suffices to impede relative horizontal rotation, i.e., angular displacement, between the structure and its foundation, and furthermore will damp linear displacement of the structure relative to the foundation in a direction parallel to the direction of the dampers. As a practical matter and preferably, a second such pair of dampers, oriented in a perpendicular or orthogonal direction relatively to the first pair, is employed to damp linear displacement of the structure in the corresponding, perpendicular or orthogonal direction. In a first embodiment employing two orthogonally-related pairs of dampers, dual hydraulic interconnections are provided between the corresponding sub-chambers of each damper as defined by their respective pistons; alternatively, in a second embodiment employing two sets of orthogonal pairs of dampers, a single hydraulic interconnection is provided between the associated dampers of each pair, and the successive dampers of the two sets which are aligned along a common wall and direction are connected in inverted relationship between the structure and its foundation.

Whereas the damper subsystem of the invention, when employed with a base isolation system of the basic or improved type disclosed herein, serves to prevent rotation of the structure in a horizontal plane relative to the foundation, the damper subsystem alternatively may be employed with base isolation systems which permit relative vertical displacements of opposite edges of a building and correspondingly to prevent rotation of the building in any vertical plane; while the dampers thus are reoriented so as to extend generally in parallel relationship in respective, orthogonally oriented vertical planes, the hydraulic interconnections and inverted mechanical connections remain the same, as when arranged to prevent rotation in a horizontal plane. In both configurations, the damper subsystem of the invention functions to prevent rotation of the structure in the commonly oriented horizontal or vertical planes, as before described, and, instead, to permit relative but damped linear displacement of the structure with respect to its foundation in horizontal and/or vertical planes, respectively. Moreover, one set of four dampers may be oriented laterally to prevent rotation in a horizontal plane, and a second such set oriented vertically, to prevent rotation in any vertical plane. Significantly, the oppositely situated dampers of a pair are hydraulically interconnected and oriented in inverted relationship as between the structure and the foundation, and thereby function to impede relative rotation of the structure and, instead, to permit relative linear displacement thereof, with respect to its foundation.

The foregoing and other objects and advantages of the present invention will become clear with reference to the accompanying drawings wherein like numerals refer to like parts throughout.

DETAILED DESCRIPTION OF THE PREFERRED EMBODIMENTS

Figure 1:
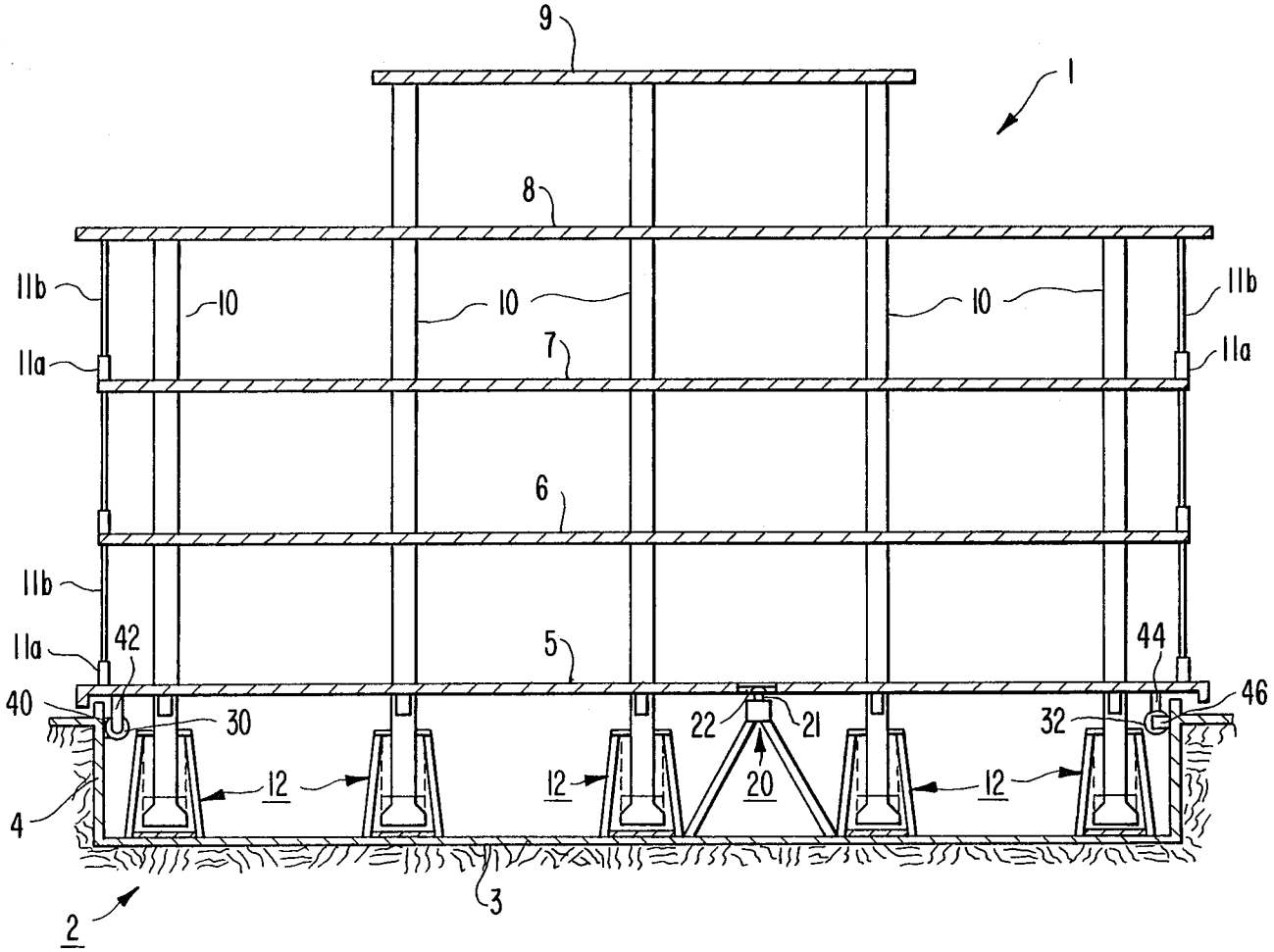
FIG. 1 is a schematic, elevational and cross-sectional view of a structure and related foundation incorporating the structure stabilization system of the present invention.

FIG. 1 illustrates in schematic form a structure 1 comprising a multi-story building and having an associated foundation 2 comprising a horizontal floor 3 and vertical walls 4. The floors 5, 6, 7, 8 and 9 of the structure 1 are individually connected to and supported by a plurality of vertical support columns 10, the exterior vertical surfaces of structure 1 being enclosed by walls 11*a* and glass panels 11*b*.

Figure 2:
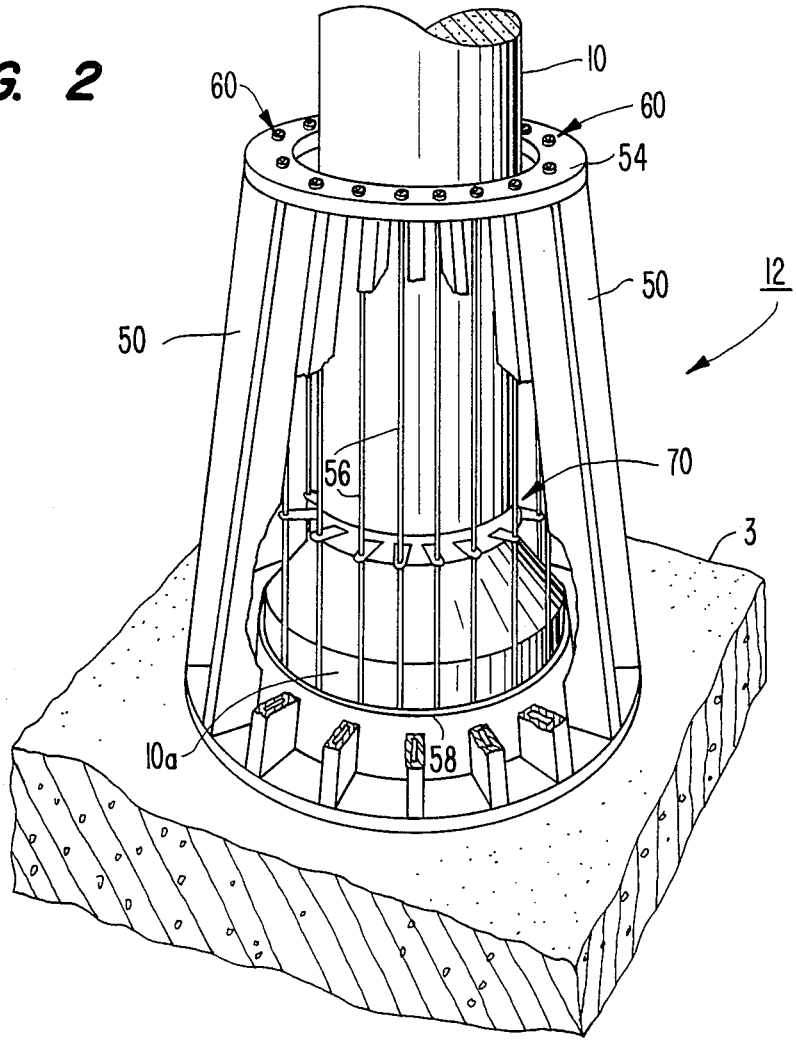
FIG. 2 is a cut-away, perspective view, partially in cross-section, of a base isolation system in accordance with the present invention.
Figure 3:
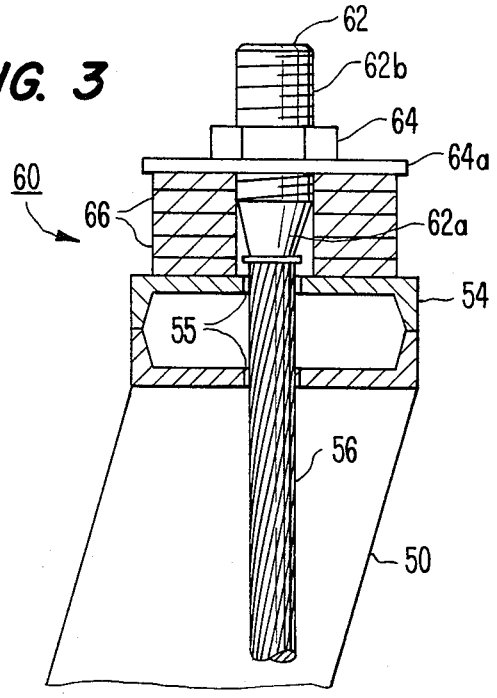
FIG. 3 is a fragmentary, cross-sectional and elevational view of portion of the base isolation system of FIG. 2.
Figure 4:
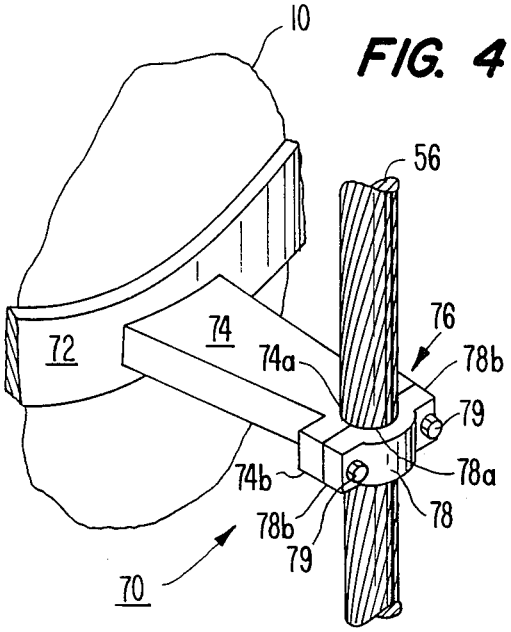
FIG. 4 is a fragmentary, detailed perspective view of a portion of base isolation system of FIG. 2.

The support columns 10 are suspended at their respective, lower ends by corresponding bases 12 which, together, comprise a base isolation system, disclosed in further detail in FIGS. 2 through 4 hereof, which minimizes the transmission of horizontal movement from the ground (and thus the foundation 2) to the structure 1, in the event of a seismic disturbance. Effectively, the base isolation system permits the structure 1 to "float" with respect to its foundation 2.

A releasable interlock subsystem 20, as later detailed, is rigidly secured to the foundation floor 3 and is releasably interlocked to the structure 1 by a pin 21 which is received in a plate 22 integrally formed in the first floor 5. Further details of the interlock subsystem are shown and discussed in connection with FIGS. 12 through 13.

The damping subsystem comprise at least two pairs of orthogonally related dampers, of which the oppositely disposed dampers 30 and 32 of a single such pair are illustrated in FIG. 1. As more fully described hereinafter, the respective dampers of a given pair are oriented in parallel relationship and are mechanically connected in inverse, or oppositely oriented, relationship between the structure 1 and its foundation 2, or other support, anchored in the ground. Thus, the damper 30 is interconnected between a bracket 40 which may be integrally formed with the foundation wall 4 and a bracket 42 secured to the floor 5. The damper 32, on the other hand, is connected in a relative, inverted relationship between the bracket 44 secured to the floor 5 and a second bracket (not seen in FIG. 1) integral with the foundation wall 4. Further details of the damping subsystem are shown and discussed in connection with FIGS. 5 through 10.

FIG. 2 is a schematic and perspective view, partially broken-away and partially in cross-section, of one of the bases 12 of the base isolation system of FIG. 1. The base 12 comprises a plurality of generally vertical, support members 50, which may comprise channel bar stock or any other structural element which can sustain the compressive force of the structure 1 as to its proportionate share thereof, including potential lateral or transverse forces which may act thereon as produced by a seismic disturbance and which typically are much smaller than the compressive force. The members 50 preferably are inwardly inclined in the direction from bottom to top, and are secured at their lower ends to a base ring 52 and at their upper ends to a support ring 54, such as by welding, thereby to form an integral, rigid and strong structure. The support column 10 passes downwardly through the support ring 54 and preferably includes an enlarged diameter base portion 10*a*. A plurality of cables 56 extend at their upper ends through corresponding through-holes in the cable support ring 54 and are secured thereto by adjustable support mechanisms 60, and are secured at their lower ends, such as by welding or other rigid interconnection, to a metal clamp 58 which is secured about the base 10*a* of the support column 10. The cables 56 further are engaged at positions intermediate their length by an adjustable gripper mechanism 70 which is secured to the support column 10 and which functions to maintain the same effective "free" length of the plural cables 56, as later detailed.

In the fragmentary and partially cross-sectional elevational view of FIG. 3, the support ring 54, which again may comprise metal bar stock of rectangular cross-section, is shown in association with one of the vertical, inclined support bars 50; ring 54 has aligned apertures 55 through which the upper end of an associated cable 56 extends, for being engaged by an associated adjustable support mechanism 60.

The adjustable support mechanism 60 provides for adjusting the actual suspension length of its associated cable 56, and comprises a metal stub 62 which is hollow at its tapered, lower end 62*a* for receiving the upper end of the cable 56 therein and to which it is welded or otherwise firmly secured. The upper end 62*b* of stud 62 is threaded for receiving a nut 64 thereon, the nut preferably having an enlarged lower flange 64*a* and being received on a series of washers 66 which are added, as required, to adjust the vertical position of the stub 62 relative to the support ring 54, in addition to the vertical height adjustment afforded by turning of the nut 64. With concurrent reference to FIG. 1, it will be appreciated that the foundation floor 3 or other base support on which the individual bases 12 are situated may vary slightly in elevation either as a result of original construction or due to settlement; further, the cables 56 may stretch unequally, over time. However, it is essential that the respective columns 10 be at the identical elevations. Thus, the selective addition of washers 66 and the vertical travel of the stub 62 by rotation of nut 64 provide for adjusting the actual suspension length of the cables 56 below the support ring 54 of the base 12, for all bases 12, thereby to achieve a common elevational position of the plural, corresponding support columns 10.

The adjustable cable gripper mechanism 70 provides for establishing the identical, effective free suspension length and thereby a common and predetermined harmonic characteristic for all cables 56 of all bases 12. As shown in further detail in the fragmentary section, perspective view of FIG. 4, the mechanism 70 comprises a band 72 which is movable to a selected, axial position relative to the column 10. Plural, radially-extending arms 74 are affixed to the band 72, preferably integrally formed therewith, each arm 74 supporting a cable clamp 76 at its outer extremity. The cable clamp 76 more particularly comprises a semi-cylindrical recess 74*a* and lateral flanges 74*b* on the extremity of the arm 74 and a mating bracket 78. The bracket 78 includes a corresponding semi-cylindrical recess 78*a* and flanges 78*b* through which corresponding bolts 79 are received and threadingly engaged in the flanges 74*b*. In use, the bolts 79 are backed off to release the clamp 76, for all such clamps 76, to permit relative vertical movement of the mechanism 70 and the corresponding cables 56, for adjusting the effective suspension lengths thereof, and thereafter are tightened to securely engage the clamps 76 onto the cables 56. The rigid interconnection of the thus-clamped cable 56 through the corresponding arms 74 and band 72 for a given base 12, while thus not supporting the weight of the support column 10 and its proportionate share of the weight of the structure 1, nevertheless defines the effective free suspension length of the cables 56. Accordingly, by so adjusting the axial positions of the bands 72 of the respective gripper mechanisms 70 for all of the associated bases 12, so as to maintain the same vertical displacement between the respective bands 70 and support rings 54 of the respective bases 12, the identical, effective free suspension length of the cables 56 may be maintained for all of the bases 12, to assure that all have the same harmonic characteristics.

It is to be recognized that alternative structures and adjustment procedures may be employed, consistent with the disclosed mechanism 60. For example, the clamps 76 for all mechanisms 70 of the respective bases 12 may be released initially and the adjustable support mechanisms 60 then operated to adjust the actual suspension length of the cables 56 to achieve common elevations of the columns 10, and the gripper mechanisms 70 then placed at common axially displaced positions relative to the respective support rings 54 of the associated bases 12 and the clamps 76 then engaged on the corresponding cables 56. Alternatively, the elevation adjustment by mechanism 60 of the corresponding columns 10 may first be achieved, and then the gripper mechanisms 70 may be individually adjusted to establish the common, effective suspension length of the corresponding cables 56, either simultaneously or in sequence for all the bases 12. Moreover, since the gripper mechanisms 70 do not support any weight of the columns 10 or the proportionate share of the structure 1, it is not essential that the cables 56 be securely engaged thereby. In this regard, the primary function of the clamps 76 is to support the gripper mechanism 70 at the desired axial position. Accordingly, an alternative embodiment of the gripper mechanism 70 comprises a band 72 which may be secured to the column 10 at a selected and desired axial position, with the cables 56 passing substantially freely through corresponding receiving apertures in a structure integral with the band 72. Such a structure could comprise arms 74 having such apertures at the extremities thereof, or an annular, continuous flange extending from the band 72 and having such apertures adjacent an outer periphery thereof and spaced so as to receive the corresponding cables 56.

Through the provision of the base isolation system and particularly wherein the cables or other flexible devices 56 for suspending the columns 10 have the same harmonic characteristics, the fundamental period T of the structural group comprising the structure 1 of FIG. 1 can be increased to a level having an acceleration response which is so small that it is effectively negligible, permitting the structure 1 effectively to be designed consistent with standards for a structure built in a non-seismic geographic area. This derives from the fact that the natural period of oscillation, T, of a pendulum, or of a mass supported by an elastic element in the case of several such masses (i.e., the structure 1 including contents), amounts to the fundamental period of oscillation. In the case of the base isolation system of the present invention, in which:

$T_1$ represents the natural period of oscillation of the pendulum system provided by the effective free suspension length ("l") of the cables ($T_1=2\pi\sqrt{l/g}$); and T2 is the fundamental period of the oscillation of the structure 1 in FIG. 1 (i.e., the upper structure of a building, exclusive of its foundation but including its contents); then:

$$T=\sqrt{T_1^2+T_2^2}$$

Thus, by properly selecting the effective, free suspension length ("l") of the suspension cables for a given structure and geographic region with known seismic characteristics, the value of T can be increased sufficiently for reducing the absolute acceleration and the corresponding horizontal inertial force to which the structure is subjected to a safe value. As one example, and as derived from data for an earthquake which occurred in Acapulco, Mexico on June 23, 1965, a five-story building having a fundamental period of oscillation of approximately T=0.2 seconds had to sustain a horizontal load corresponding to an acceleration of 0.24 g. By utilizing the base isolation system of the invention having cables of a free suspension length of 1.00 meter and thus a fundamental period of $T_1=2$ seconds, the horizontal acceleration would have been decreased from 0.24 g to 0.02 g—i.e., a decrease of greater than 90%, or a resultant value of less than 10%, of the horizontal acceleration to which the building would be subjected, absent the base isolation system of the invention. In the official Regulation Spectrum published for the building and city in question, the design criteria for horizontal acceleration, as a function of the fundamental period of oscillation of the building, assumes that damping of 5% of the critical value of damping is afforded.

The percentage value of damping achieved in a given structure can contribute significantly to the horizontal loading of the structure in the event of a seismic disturbance. For the building of the above example, the Regulation Spectrum would demand that it be designed to withstand a horizontal load of 40% of g (i.e., 0.40 g, where "g" is acceleration due to force of gravity). By increasing damping to 20% of the critical value, and using the same free suspension length of cables of 1.00 meter ($T_1=2$ sec.), the horizontal load demand would be decreased to no more than 4% (0.04) g, and possibly less. However, while prior art damper systems are known, their particular implementations do not adequately accommodate the force factors which may act on a structure during a seismic disturbance and indeed may contribute to gyrations and rotations of the structure producing oppositely oriented, linear displacements at the opposite walls of the structure relative to its corresponding foundation walls.

More particularly, for a structure having a base isolation system which does not afford the characteristics of the basic base isolation system disclosed in Canadian Patent No. 872,116 or of the improved such system as disclosed herein, the horizontal projection of the structure's center of gravity commonly does not coincide with the centroid of the forces which oppose the horizontal displacement of the earth. As a result, forces acting on the structure as during a seismic disturbance may produce rotation of the structure relative to its foundation and which rotation, in turn, produces linear displacements between the structure and the foundation, which occur in opposite directions along the opposing foundation/structure walls on opposite sides of the axis of rotation. These displacements are proportional to the distances of the respective walls from the center of rotation of the structure, and add to the linear displacement produced by translation of the structure relative to its foundation along one of these opposed foundation/structure walls. The increased linear displacement is a matter of serious concern, since it increases the probability of physical impact between elements attached to the structure and interconnecting and supporting same with respect to its base or foundation. For example, in FIG. 2, such impact could occur between the vertical column 10 and the support ring 54 of the base 12.

In prior art structural stabilization systems of the type disclosed in the afore-noted Canadian Patent No. 872,117, and in the improved base isolation system of the present invention, the above-mentioned problems are compensated for when the two orthogonal accelerograms of the earthquake are in phase; slight gyrations of the structure can occur when the accelerograms are out of phase but these generally are small. However, prior art systems utilizing independently acting shock absorbers may produce substantial such gyrations. In either circumstance, the damper subsystem of the present invention, employing hydraulically interconnected damper pairs having respective, inverted connections between the foundation and the structure, prevents such gyrations.

Figure 5:
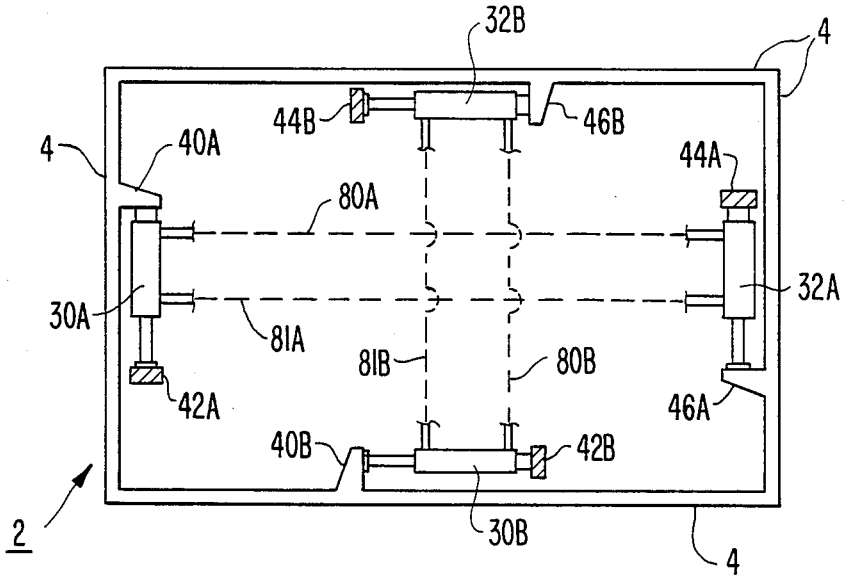
FIG. 5 is a plan view, in schematic form, of a first embodiment of the damper subsystem of the present invention employing two orthogonally related pairs of tandem connected dampers.

FIG. 5 is a schematic, plan view illustrating a first embodiment of the damper subsystem in accordance with the present invention, employing the minimum required complement for a practical system of two orthogonally related pairs "A" and "B" of dampers 30A, 32A, and 30B, 32B. The dampers of each pair are interconnected hydraulically and mechanically mounted in inverse relationship, as discussed in relation to FIG. 1, the individual dampers being centrally disposed along the respectively associated structure/foundation walls. Thus, damper 30A is connected between the bracket 40 integral with the wall 4 and the bracket 42 attached to the floor 5, whereas damper 32*a* is mounted in inverted relationship between the bracket 44A connected to the floor 5 and the bracket 46 integral with the wall. Pairs of hydraulic lines 80A, 81A and 80B, 81B respectively interconnect the pairs of dampers 30A, 32A and 30B, 32B in a manner more fully disclosed in FIG. 6 for a representative such pair of dampers, generally designated 30 and 32.

Figure 6:
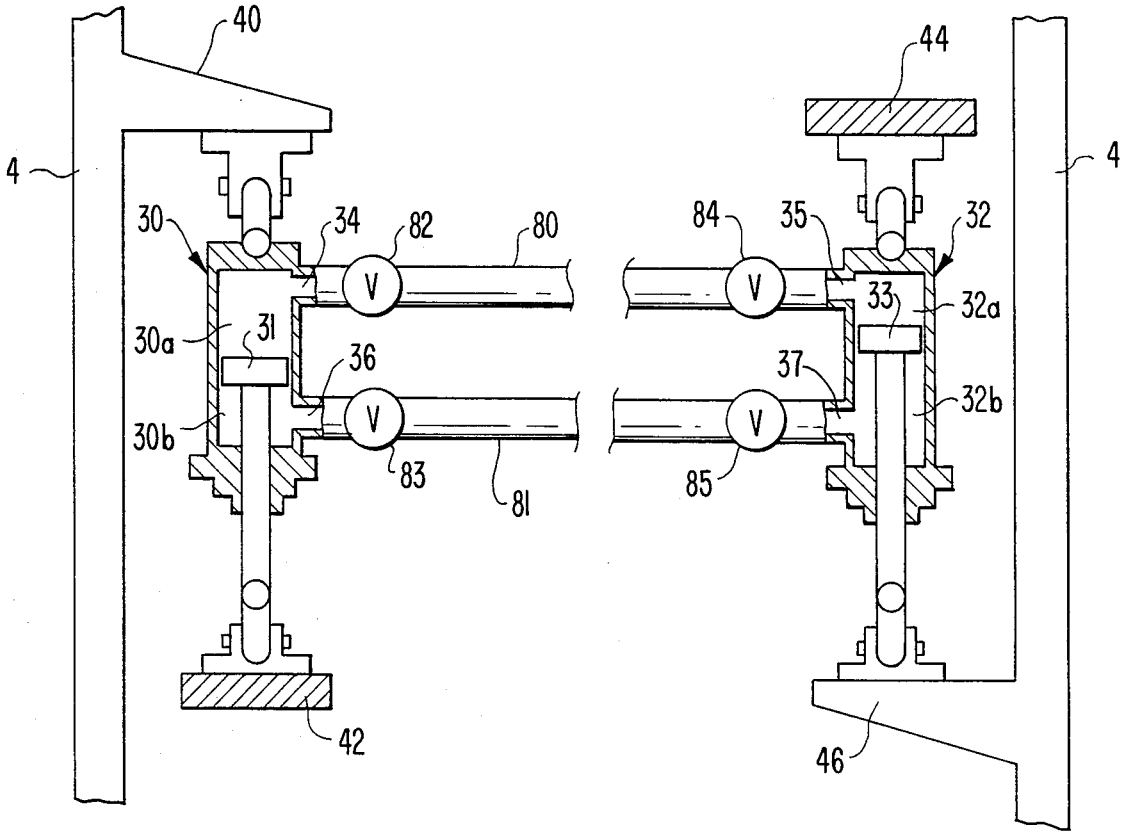
FIG. 6 is a fragmentary, enlarged view, partially in cross-section, of an interconnected pair of tandem dampers of the damper subsystem of FIG. 5.

In FIG. 6, the dampers 30 and 32 have corresponding pistons 31 and 33 defining corresponding sub-chambers 30*a*, 30*b* and 32*a*, 32*b* therein. The pistons 31 and 32 are movable in sealed relationship with the corresponding cylindrical interior sidewalls of the respective dampers, against the pressure of hydraulic fluid contained therein and in response to the forces tending to produce relative linear movement between the structure 1 and the foundation walls 4, as transmitted through the respective brackets 40, 42 and 44, 46.

The valves 82–85 are optional in certain respects and are discussed in more detail hereinafter in relation to FIG. 11. They are illustrated to indicate the location of certain valve and bypass arrangements as discussed in relation to FIG. 11 and, for the present, may be assumed to be nonexistent or to be in a permanently open condition. Thus, the dampers 30 and 32 are hydraulically interconnected through hydraulic lines 80 and 81, the line 80 connecting through orifice 34 with chamber 30*a* of damper 30 and through orifice 35 with chamber 32*a* of damper 32. In like manner, line 81 connects through orifice 36 with chamber 30*b* of damper 30 and through orifice 37 with chamber 32*b* of damper 32.

The inverted relationship of the mechanical connections of the respective dampers 30 and 32 of the pair shown in FIG. 6 between the structure and the foundation, and their resulting functional performance, will be understood from the following. Initially, it is important to understand the inverse relationship of the mechanical connections of the associated dampers of a given pair between the structure and its associated foundation. Specifically, the "upper" (i.e., in the view of FIG. 6) end of damper 30 is connected to bracket 40 integral with the foundation wall 4, whereas the "upper" end of the damper 32 is connected to bracket 44 secured in turn to the structure. Conversely, the "lower" ends of the dampers 30 and 32 are respectively connected to bracket 42 in turn secured to the structure and bracket 46 integral with the foundation wall 4. Moreover, whereas the associated dampers of a pair are to be in parallel alignment as shown in FIG. 6, the orientation thereof is not limiting. Thus, whereas dampers 30 and 32 in FIG. 6 are shown to be commonly oriented it will be seen from FIGS. 9 and 10 that the dampers themselves may be oppositely oriented while nevertheless maintaining the inverse mechanical connections of the respective, associated dampers of a pair between the structure and its foundation. It may be assumed that pistons 31 and 33 are normally centrally located within their respective, identical dampers 30 and 32 and thus define corresponding, identical sub-chambers 30*a*, 30*b* and 32*a*, 32*b*. As shown in FIG. 6, bracket 44 (attached to structure 1) and bracket 46 (attached to foundation wall 4) are illustrated as having moved more closely together, piston 33 thus increasing the pressure within and expelling fluid from chamber 32*a*. Since the hydraulic fluid is essentially non-compressible, it travels through line 80, filling the chamber 30*a* of damper 32 and expanding the volume of same, thereby driving piston 31 downwardly (i.e., in the orientation of FIG. 6) and relatively displacing bracket 42 (attached to structure 1) from bracket 40 (attached to foundation wall 4). In the same context, movement of piston 31 from an original, central position to the position indicated decreases the volume of chamber 30*b*, increasing the pressure therein and expelling the fluid therefrom, and thereby increasing the volume of fluid and pressure in chamber 32*b* of damper 32 and raising piston 33, as shown therein. Correspondingly, a downward displacement of bracket 42 relatively to bracket 40, as viewed in FIG. 6, produces increased pressure within sub-chamber 30*b* which is communicated through line 81 to sub-chamber 32*b* which then interacts between the piston 33 fixed to the bracket 46 (and in turn to the foundation wall 4) and the housing of damper 32, tending to draw damper 32 and its associated bracket 44 (attached to structure 1) downwardly as viewed in FIG. 6.

Whereas the terms "upward" and "downward" movements in reference to FIG. 6 have been used for ease of description, it will be understood that these movements correspond to lateral displacements in a horizontal plane, as shown in FIG. 5. It further will be understood that any tendency of the structure to rotate relatively to the foundation walls 4 will be impeded and only relative lateral displacement therebetween is permitted. Consider, in FIG. 6, the case of the structure attempting to rotate in a clockwise direction relatively to the foundation walls 4, causing a decrease in volume of chamber 32*a* for the conditions above referenced; as above explained, the fluid expelled from chamber 32*a* tends to increase the volume of fluid in chamber 30*a*. This action opposes the upward movement of bracket 42 relatively to bracket 40 and thus is consistent with impeding such counterclockwise rotation.

FIG. 6 furthermore illustrates the circumstance that a single pair of dampers 30, 32, hydraulically interconnected and mechanically mounted in inverted relationship, all as above described, serves both to impede relative rotation and also to permit only damped, relative lateral displacement in a direction parallel to the parallel-axial orientation of the dampers 30, 32. Assuming that the dampers 30, 32 of FIG. 6 correspond to dampers 30A, 32A of FIG. 5, a second pair of dampers 30B, 32B disposed in orthogonal relationship to the dampers 30A, 32A then is required for damping relative lateral displacements in the corresponding, orthogonal direction.

FIG. 6, in an alternative interpretation, also serves to illustrate application of the damper subsystem of the invention for preventing rotation of a structure in a vertical plane relative to its associated foundation while permitting only vertical, linear displacement therebetween. In this regard, it need simply be assumed that FIG. 6 is an elevational view and that the walls 4 and brackets 40, 46 are in cross-section, and further that the brackets 42, 44 represent vertical cross-sections of brackets secured to a structure 1 which is supported vertically above the elevation of bracket 40 of the left wall 4.

The use of the damper subsystem to impede rotation in a vertical plane, of course implies the use of a base isolation system which otherwise permits such rotation of the structure, for example a system as shown in U.S. Pat. No. 3,110,464—Baratoff. A number of such systems are also discussed in "Aseismic Base Isolation: A Review," PROCEEDINGS OF THE SECOND U.S. NATIONAL CONFERENCE ON EARTHQUAKE ENGINEERING, August 1979, pages 823–836 and references cited therein. In addition to impeding rotation and limiting relative movement to lateral displacement in vertical directions, a vertically oriented damper subsystem in accordance with the invention may likewise incorporate a flow restriction system as discussed hereinafter in relation to FIG. 11 so as to dissipate energy and eliminate gyrations and rotations in a vertical plane.

Figure 7:
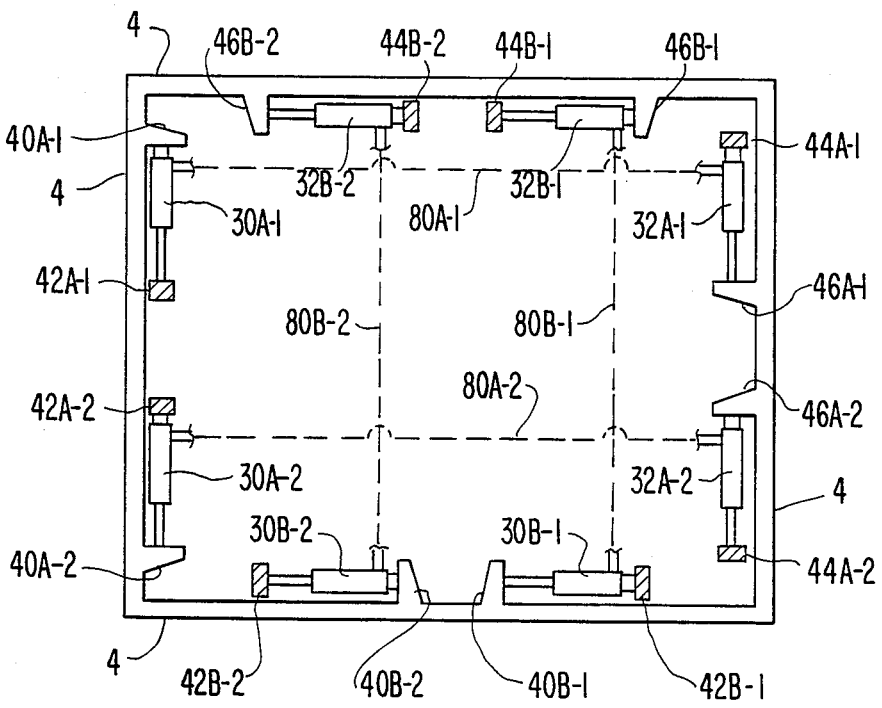
FIG. 7 is a schematic, plan view of a second embodiment of a damper subsystem in accordance with the invention employing plural, orthogonally related pairs of tandem dampers.

FIG. 7 is a schematic, simplified plan view of a second embodiment of the damper subsystem of the invention illustrating the use of plural, orthogonal pairs of interconnected and reverse oriented dampers. As more particularly shown in FIG. 7, two sets of orthogonal pairs A-1, B-1 and A-2, B-2 of dampers are employed. Particularly, the first set comprises the pair (A-1) of dampers 30A-1 and 32A-1 and the pair (B-1) of dampers 30B-1 and 32B-1. The second set comprises the pair (A-2) of dampers 30A-2 and 32A-2 and the pair (B-2) of dampers 30B-2 and 32B-2. Significantly, not only are the hydraulically interconnected dampers of a given pair connected mechanically in inverted relationship between the structure and the foundation, but also the successive dampers along a given wall are likewise connected mechanically in inverted relationship between the structure and the foundation. To illustrate, the associated dampers 30A-1 and 32A-1 of a first such pair are mechanically connected in inverted or oppositely oriented relationship and the successive dampers 30A-1 and 30A-2 of the first and second such pairs aligned along the common wall 4 (i.e., the left wall 4 in FIG. 7) are likewise inversely oriented as to their mechanical connections between the structure and the foundation.

The use of such complementary sets of damper pairs as shown in FIG. 7 permits simplification of the hydraulic interconnections between the associated dampers of the pairs thereof; particularly, only single interconnecting lines, or conduits, 80A-1, 80A-2, 80B-1 and 80B-2 interconnect the associated dampers of the corresponding pairs, e.g., the conduit 80A-1 interconnects dampers 30A-1 and 32A-1. As will be understood, the inverse relationship of the aligned dampers 30A-1 and 30A-2 of the two sets and of their respective, inversely mounted, paired dampers 32A-1 and 32A-2 aligned along the opposing wall 4, provide the equivalent interconnection function of the dual hydraulic conduits, for example, conduits 80 and 81 in FIG. 6.

Figure 8:
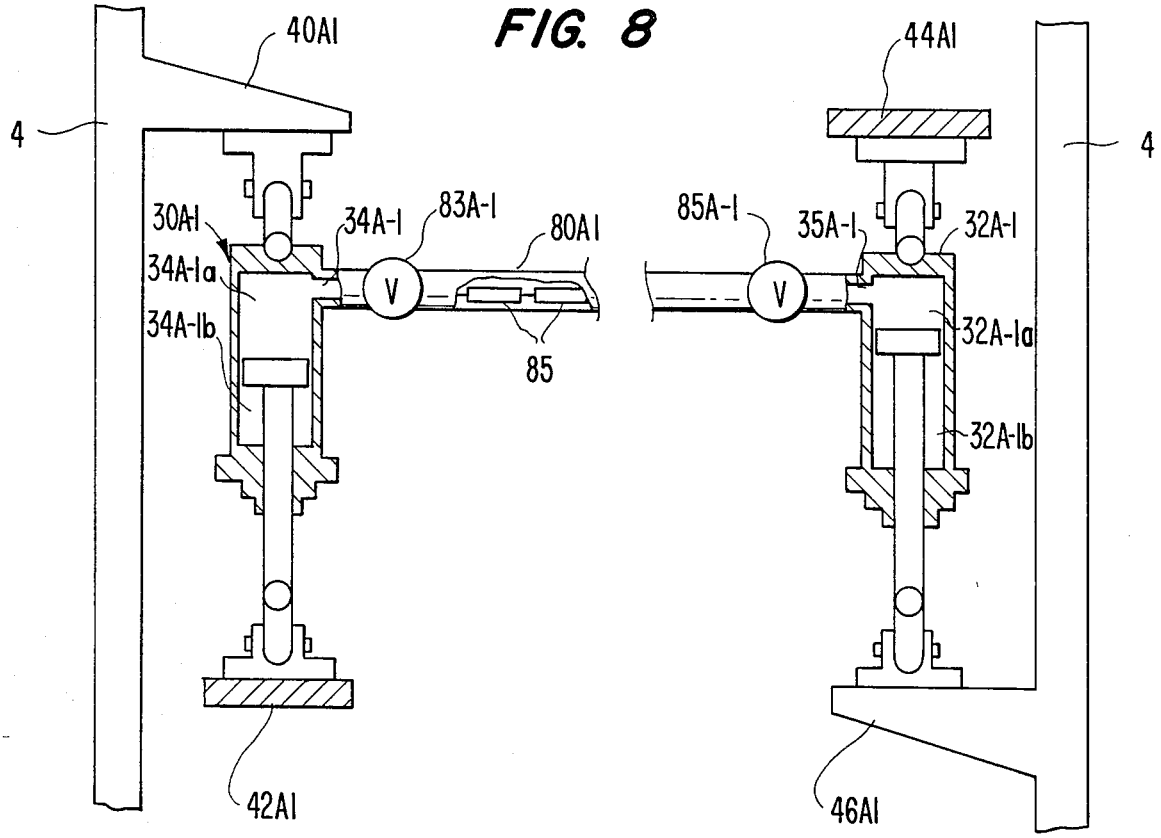
FIG. 8 is a fragmentary view, partially in cross-section, of an interconnected pair of tandem dampers in accordance with embodiment of FIG. 7.

FIG. 8 illustrates in greater detail the interconnecting hydraulic line 80A-1 with its associated dampers 30A-1 and 32A-1. Valves 83A-1 and 85A-1 are illustrated and have the same significance as the valves, e.g., valves 83 and 85, illustrated in FIG. 6 and to which further discussion will be directed in connection with FIG. 11. It will also be understood from FIG. 8, when expanded for example to include the successive and respectively inverted and hydraulically interconnected pair of dampers 30A-2 and 32A-2 (i.e., as in FIG. 7) and when alternatively interpreted as illustrating a vertical orientation, or elevational view, that successive and inversely related pairs of dampers as in FIG. 7 may be employed to prevent rotation of a structure relative to its foundation in a vertical plane.

Figure 9:
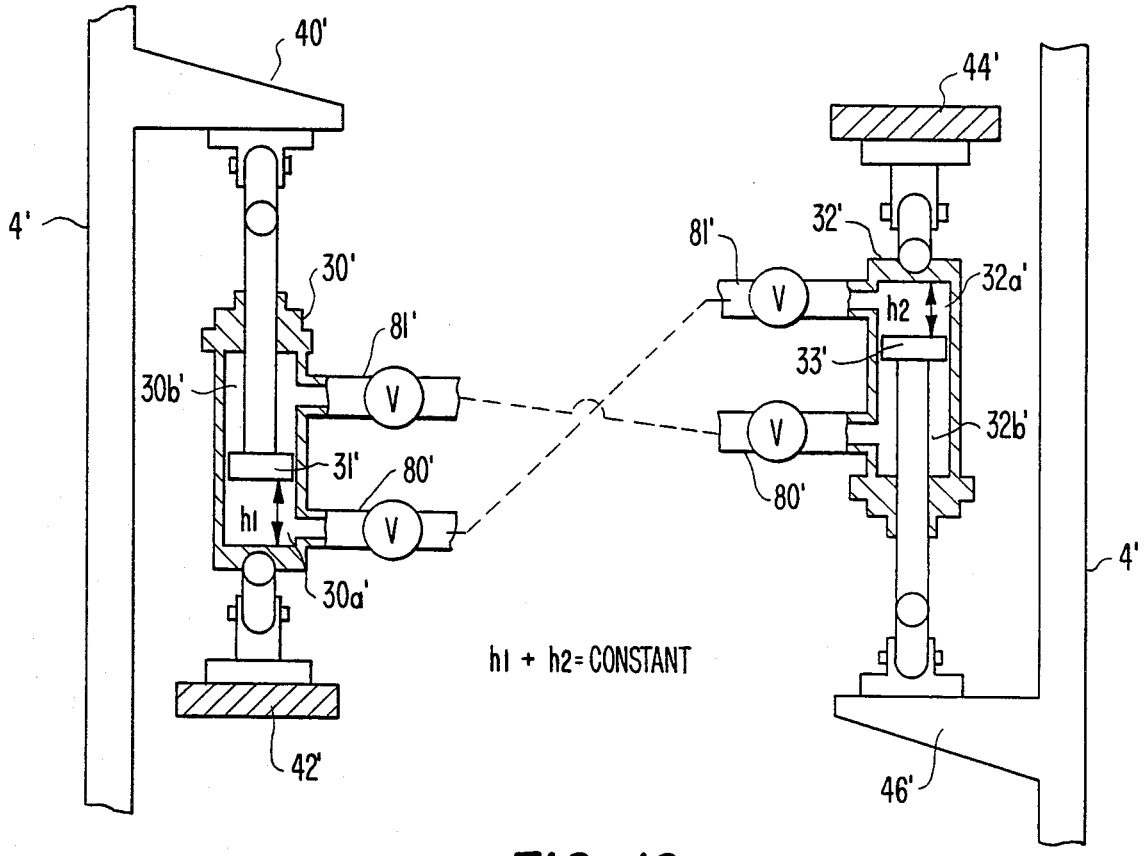
FIGS. 9 and 10 are fragmentary, enlarged views, partially in cross-section, of interconnected pairs of tandem dampers in accordance with the damper subsystem embodiments of FIGS. 6 and 8, respectively, but illustrating alternative mechanical connections of the dampers of each pair relatively to the associated structure and foundation.
Figure 10:
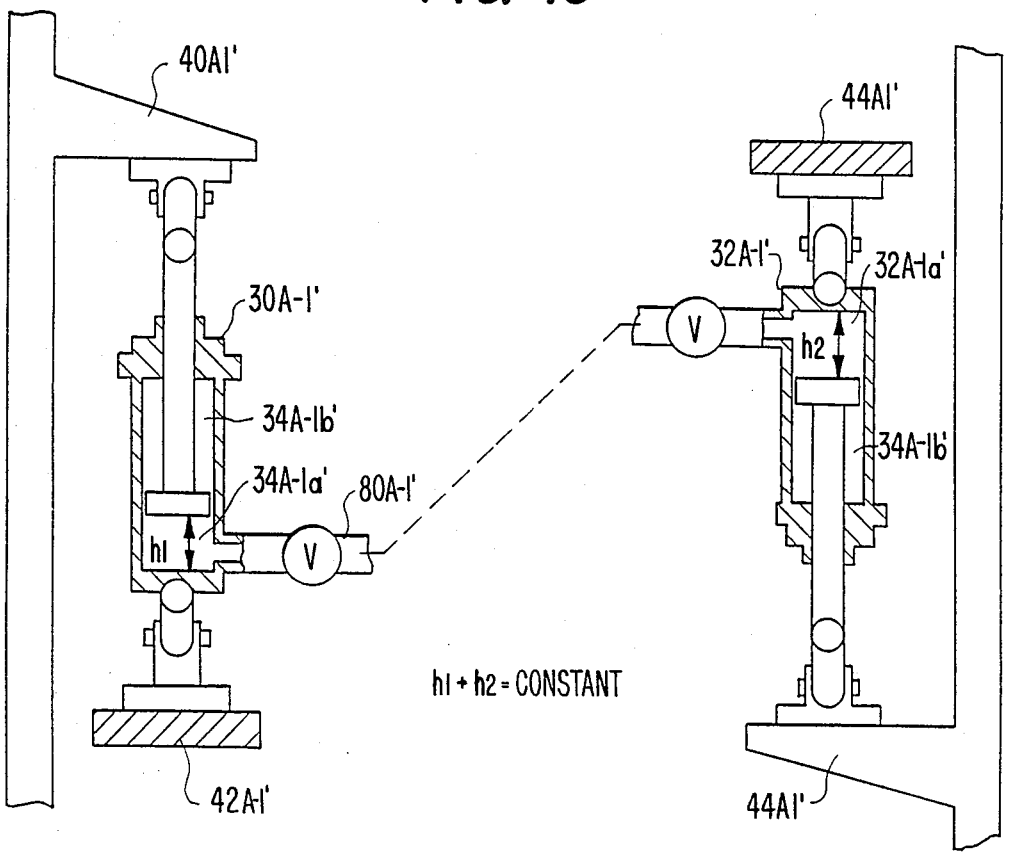

FIGS. 9 and 10 represent alternative arrangements of damper pairs for achieving the same, effective inverse mechanical connections of the associated dampers of each pair between a structure and its foundation, as compared to the (single set) system of FIGS. 5 and 6 and the (two set) pair system of FIGS. 7 and 8. Corresponding elements of FIGS. 9 and 10 are identified by identical, but primed, numerals as in the corresponding FIGS. 6 and 8. On close analysis, it will be seen that the only differences in FIG. 9, compared to FIG. 6, are that the damper 30' is reversed as to its interconnection between the structure support bracket 42' and the foundation bracket 40' and correspondingly that the hydraulic lines 80' and 81' are now in crossed or diagonal relationship. As a result, the line 80' interconnects chambers **30*a*' and 32*a*' and line 81' connects chambers 30*b*' and 32*b*' in the same sense as those same (but unprimed) numerically designated elements are interconnected in FIG. 6. FIG. 10 likewise may be related to FIG. 8, the damper 30A-1' being in reversed position relatively to damper 30A-1 in FIG. 8, while the conduit 80A-1' diagonally interconnects chambers 34*a*-1' and 32*a*-1'**.

The systems as illustrated in FIGS. 9 and 10 are presently preferred over those of FIGS. 6 and 8, respectively, in that the damper housings are connected directly to the respective brackets associated with the movable structure (brackets 42' and 44' in FIG. 9 and 42A-1' and 44A-1' in FIG. 10), and the corresponding pistons thereof are connected to the respective brackets associated with the foundation walls 4' (brackets 40' and 46' in FIG. 9 and 40A-1' and 44A-1' in FIG. 10). Thus, the interconnecting hydraulic lines (lines 80' and 81' in FIG. 9 and line 80A-1' in FIG. 10) may be supported by and thus be non-movable with respect to the associated structure.

It will also be understood that yet a further alternative is available in which the housings of the dampers are connected to the support brackets integral with the foundation walls, and the pistons are connected to the brackets associated with the movable structure. In that configuration, the hydraulic interconnecting lines would remain stable and non-movable with respect to the foundation.

While generally it may be assumed that the hydraulic fluid employed in the damper system embodiments of the invention is incompressible or at least that, in many cases, compressibility is negligible, one may have to consider the dimensional factors involved. Particularly, due to the length of the interconnecting conduits for very large structures, the compressibility of the hydraulic fluid may reduce the full effectiveness of the damping function. FIG. 8 additionally illustrates a feature for compensating for that effect; particularly, in the cutaway section of the conduit 80A-1, there are illustrated aligned and interconnected metallic cylinders 85, formed of aluminum or other light metal but which have far less compressibility than the fluid and occupy a substantial portion of the volume within the conduit. Depending on the respective lengths of the conduit and the cylinders 85, the latter may be left free to reciprocate with the fluid within the respective conduits. Alternatively, the cylinders 85 may be secured in a suitable manner so as to remain in a substantially fixed axial position within the respective conduit despite the flow of hydraulic fluid thereover.

As before-noted, the valves included in the conduit lines interconnecting the dampers in each of the various embodiments have been assumed to be absent, or held open, as thus far described. The hydraulic interconnections of the dampers function, under those circumstances, to stabilize a structure against rotation when the single pin, releasable interlock system 20 is functioning and particularly to impede rotation while permitting only relative lateral displacement, in either vertical or horizontal planes, as permitted by the base isolation system. A valve structure 140 as shown in FIG. 11 may be employed at the position of each of the valves shown in the preceding FIGS. 6, 8, 9 and 10 to afford the design capability of introducing an optimum percentage of critical damping for reducing the absolute acceleration response of a building—and thus the horizontal inertia force that will act on it in the event of an earthquake—to safe levels. At the same time, the dampers reduce the amount of relative linear displacement from that amount otherwise permitted by the base isolation system.

Initially, it should be noted that the hydraulic systems as thus far described may suffice, in themselves, to provide a sufficient percentage of critical damping, due to internal friction, or flow restriction, through the interconnecting hydraulic lines and associated orifices of the dampers. Thus, for example, the orifices 34–37 in FIG. 6 and the interior dimensions of the associated hydraulic lines 80 and 81, taking into account the length thereof, may provide a sufficient such percentage of critical damping.

Figure 11:
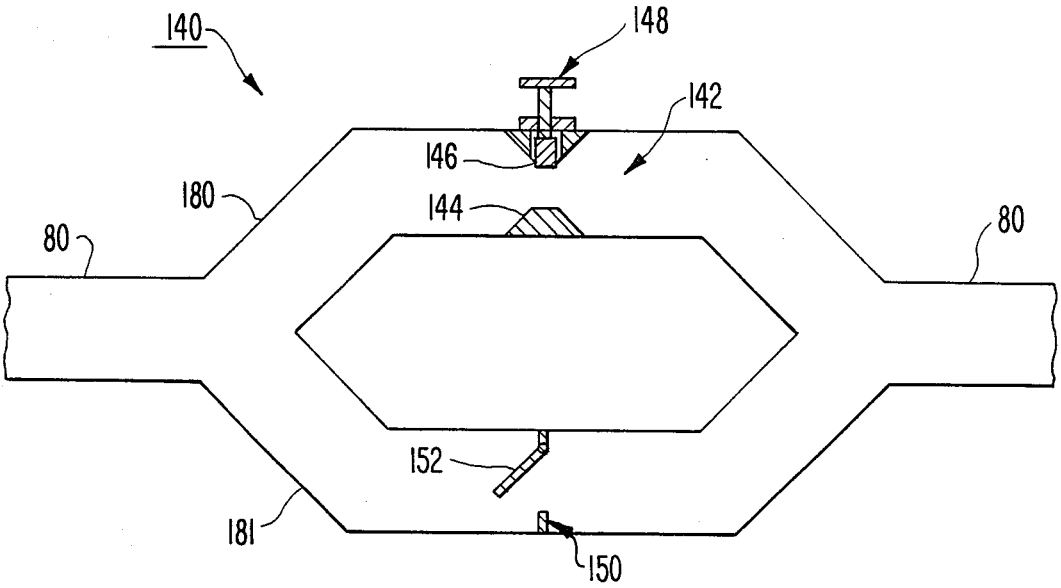
FIG. 11 is a schematic illustration of the optional valves included in the hydraulic interconnection lines between the pairs of associated dampers as illustrated in FIGS. 6, 8, 9 and 10.

The arrangement of FIG. 11, on the other hand, provides for adjusting and thereby optimizing the percentage of critical damping in accordance with either or both of the following provisions. Particularly, line 80 may include a variable orifice assembly 142 (shown in branch 180) comprising a fixed annular restriction 144 and a movable gate 146 adjusted in position by the rotation of handle 148 to further restrict the opening and thus impede the flow of fluid.

If a higher percentage of critical damping is required, a further provision may be made of a check valve 150 which is shown connected in the parallel branch 181, the hinged valve 152 being oriented to be closed in response to the increase in pressure in the chamber of the damper with which the valve 140 is associated. Thus, when the valve assembly 140 of FIG. 11 is employed as the valve 82 in FIG. 6, the check valve 150 would have valve member 152 oriented as shown in FIG. 11, such that it would close in response to an increase in pressure in chamber 30*a*, cutting off the flow of fluid expelled from that chamber. Conversely, the valve member 152 would be oppositely oriented, when employed as the valve 84 in FIG. 6, such that the restricted flow through the adjustable orifice 142 (i.e., of the valve 82) would pass through the hydraulic line 80 and the now opened check valve 150 (i.e., of the valve 84).

Figure 12:
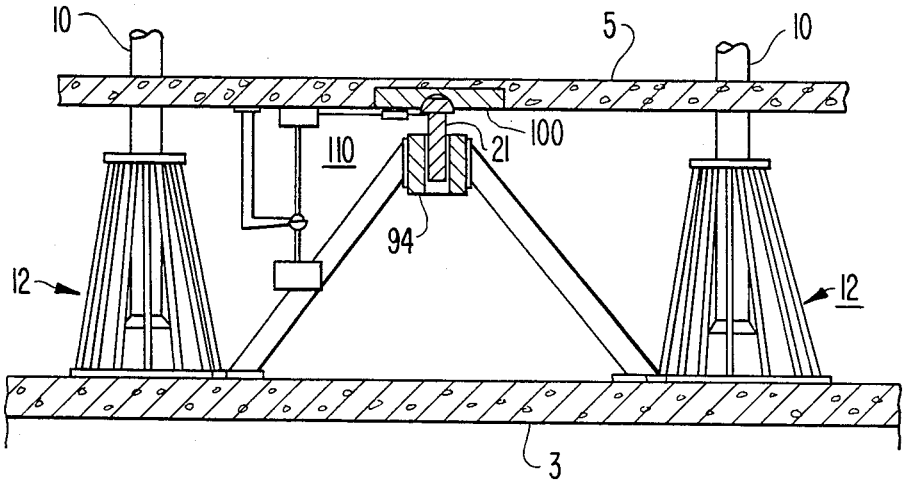
FIG. 12 is a schematic, elevational view, partially in cross-section, of a releasable interlock subsystem in accordance with the invention.
Figure 13:
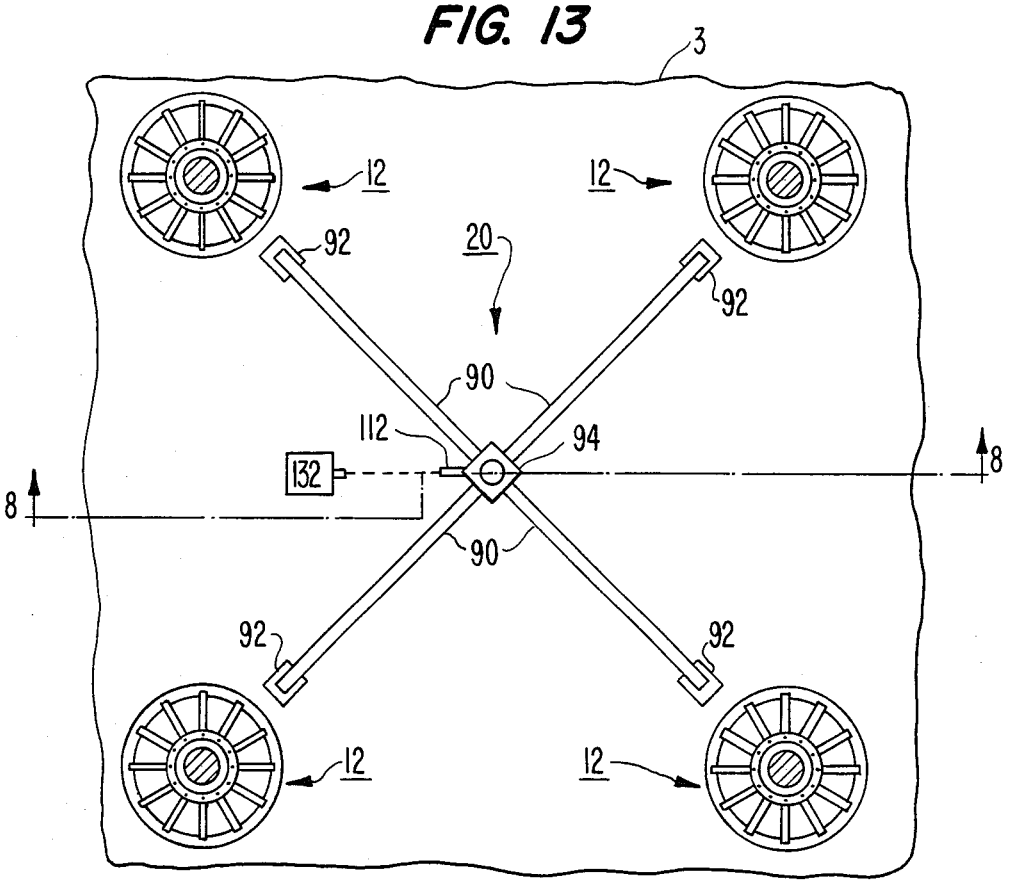
FIG. 13 is a schematic, plan view of the releasable interlock subsystem of FIG. 12.
Figure 14:
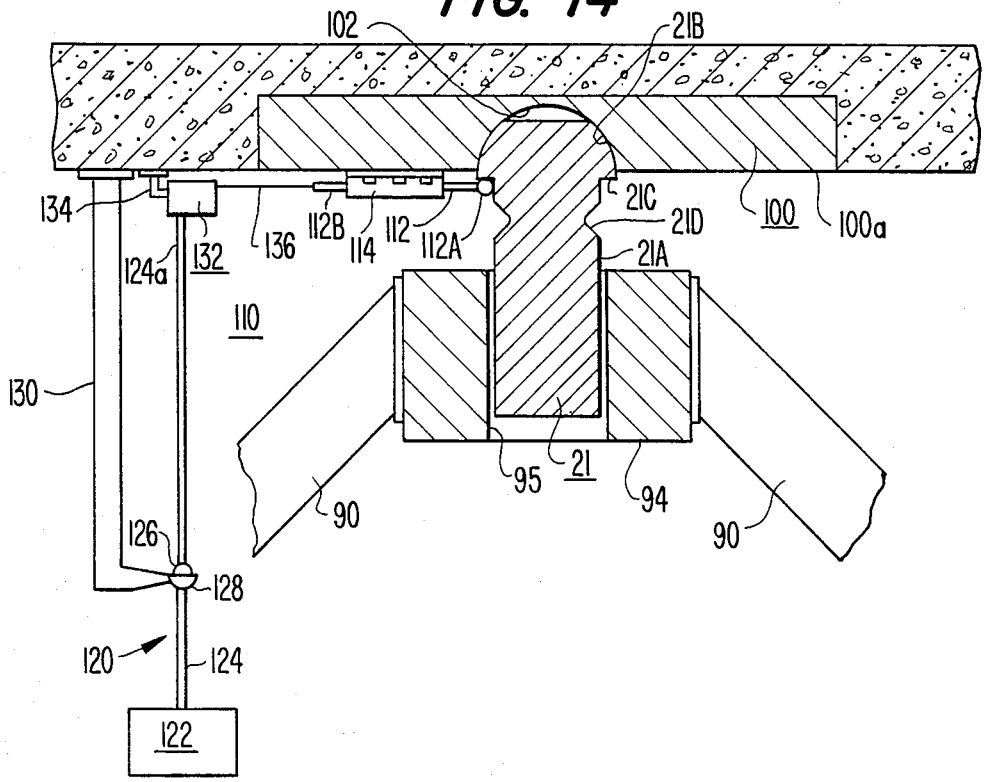
FIG. 14 is a schematic, elevational view, partially in cross-section, of the releasable interlock subsystem of FIG. 12.

As before-noted, the releasable interlock subsystem 20 of the invention is shown in further detail in FIGS. 12 through 14, to which concurrent reference is now had. Legs 90 are anchored at their lower ends by pads 92 to the foundation floor 3 and are integrally joined at their upper ends to a housing 94 so as to provide a rigid, positioning support for the housing 94 in both vertical and horizontal directions. Interlock pin 21 includes an elongated shank portion 21*a*, typically of cylindrical configuration, and an enlarged head portion 21*b* of a convex partial, hemispherical configuration and defining an annular, underlying lip 21*c*. A rigid metal plate 100 is formed integrally in the floor 5 which, typically, is of reinforced concrete and thus which may be poured to encompass the plate 100 therewithin. The lower, exposed surface 100*a* of plate 100 includes a centrally located recess 102 of mating configuration, and thus hemispherical and concave, for receiving the hemispherical head portion 21*b* of the pin 21 in a ball and socket, male-female interconnection. The "ball and socket" arrangement thus afforded, while not limiting, is believed preferred since it can accommodate slight misalignment of the pin 21 and the recess 102 without prohibiting the release function to be performed.

The pin 21 is maintained in the elevated and engaged position shown in FIG. 14, interlocked with the plate 100, by a release mechanism 110 which illustratively includes a bar 112 which is supported by bracket 114, conveniently secured in turn to the plate 100, and which permits reciprocating axial movement of the bar 112. Head 112*a* of the bar 112 is received under the lip 21*c* of pin 21 to maintain same in its upward, interlocked position, under normal conditions. The single pin 21 thus functions to maintain the structure substantially rigid and laterally non-movable despite the application of minor forces, e.g., wind, to the building. As before-noted, the damping subsystem is used in conjunction with the releasable interlock mechanism to prevent rotational movement, under such normal circumstances.

In response to forces above a predetermined threshold being exerted on the building, release mechanism 110 withdraws the bar 112 from pin 21, allowing same to drop vertically through the channel 95 in the housing 94 and thus be released from the plate 100, whereupon the building is free to move, to the extent permitted by the dampening subsystem and the base isolation system. Any suitable means responsive to detection of forces exceeding the threshold may be provided for withdrawing the bar 112. The pin 21, when released, will fall away from the plate 100 but lip 21*c* will be engaged on the upper, surrounding surface of the housing 95 to retain same therewithin. Accordingly, following conclusion of the earthquake, pin 21 may be raised into the engaged position and bar 112 moved into its locking position, as shown in FIG. 14.

Pin 21 furthermore may have a reduced neck portion 21D and be constructed of a suitable material, as is known in the art, so as to comprise a shear pin of predetermined breaking force such that it will be sheared in response to movement of the structure 1 relative to the interlock system 20 in the event of a seismic disturbance. Preferably, the shear force of pin 21 is selected at a second, predetermined threshold greater than that required for actuation of the release mechanism 110, whereby the pin is only subject to shearing in the event that the release mechanism 110 fails to operate.

As schematically illustrated in FIG. 14, one form of the release mechanism 110 may comprise a pendulum 120 comprising a mass 122 held in suspension by an elongated shaft 124 pivotally supported by a ball 126 fixedly secured to the shaft 124 and received in a socket 128 supported by bracket 130 from the floor 5. A differential mechanism 132 is mounted by bracket 134 to the floor 5 and is attached to the upper end 124*a* of shaft 124 and through a flexible metal cable 136 to the free end 112*b* of rod 112, and functions to convert any direction of movement of the end 124*a* to a rectilinear, pulling force on cable 136. Thus, when a seismic disturbance producing forces above a predetermined threshold occurs, the corresponding movement of mass 122 pivots the arm 124 in its ball and socket support 126, 128 and produces sufficient motion of the upper end 124*a* of the arm 124 so as to withdraw the pin 112 from its interlocking position illustrated in FIG. 11, permitting pin 122 to fall downwardly and release structure 1 (FIG. 1).

Figure 15A:
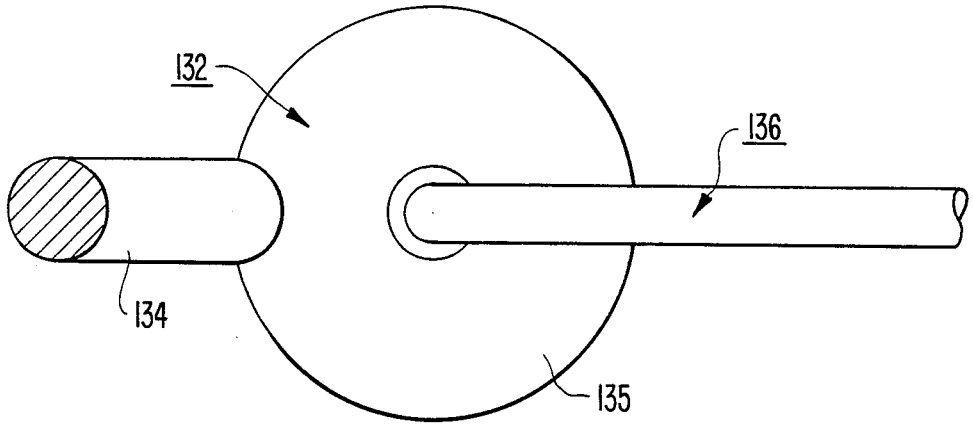
FIGS. 15A and 15B are schematic and broken away, plan and elevational views, partially in cross-section, of details of a specific, illustrative embodiment of the differential mechanism 132 of FIG. 14.
Figure 15B:
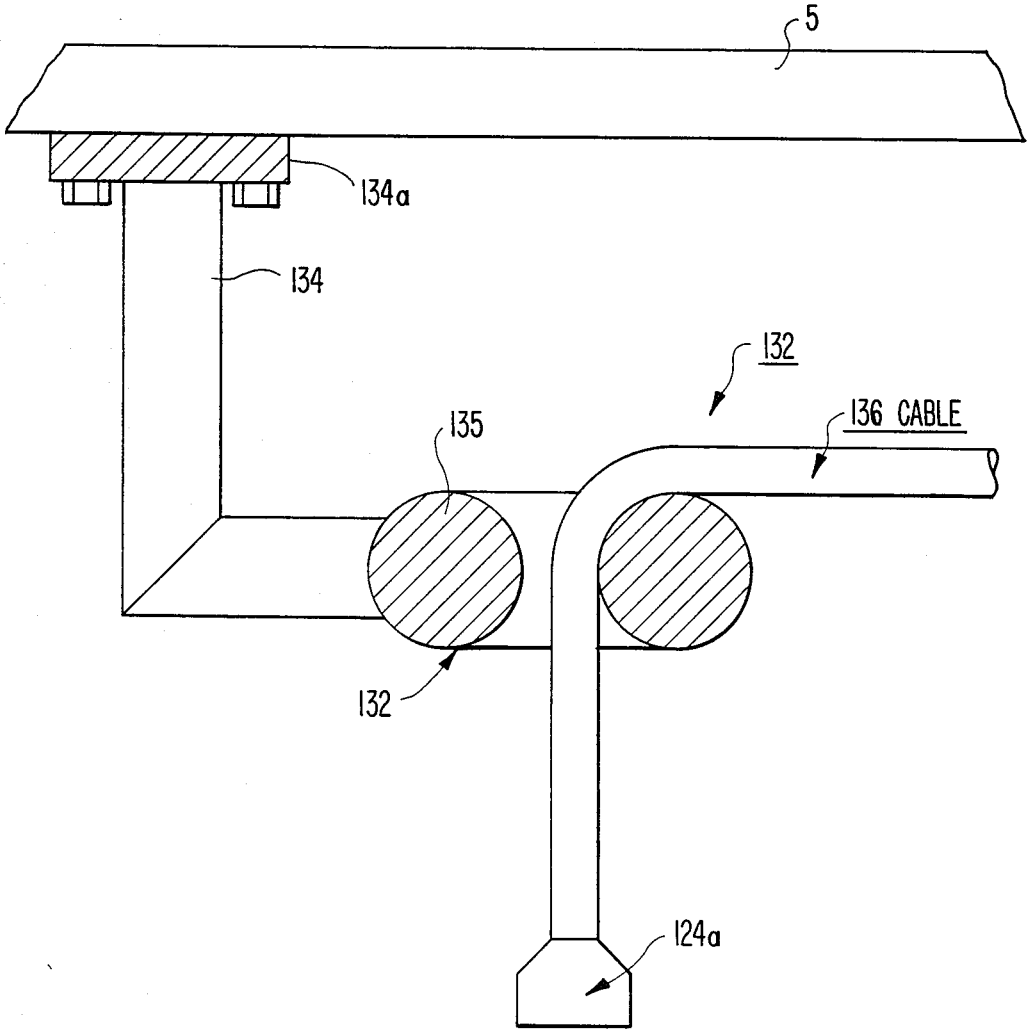

The differential mechanism 132 is shown in fragmentary and schematic plan and elevation views in FIGS. 15A and 15B. With concurrent reference thereto, bracket 134 may be secured to the lower surface of the first floor 5 of structure 1 (shown in FIG. 1) by bolts received through a flange 134A. Bracket 134 supports on the lower end thereof an annular ring 135 through which the cable 136 is received. The depending end of cable 136 is connected to the upper end 124A of the support rod 124, such that motion of the latter in any direction will exert a pulling force on the cable 136.

The release mechanism 110 may take many forms, of which the mechanical pendulum 120 is but one example. Automatic hydraulic devices, solenoids (preferably operable through an emergency local power supply or one provided at least as backup for commercial power supply to the structure) or other mechanical switching mechanisms such as a pre-tensioned spring may provide the power source for withdrawing the bar 112. Whereas the pendulum function afforded by mass 122 and its support rod 124 also perform the sensor function, an accelerometer or other sensor could be employed for activating such alternative release mechanisms.

Figure 16A:
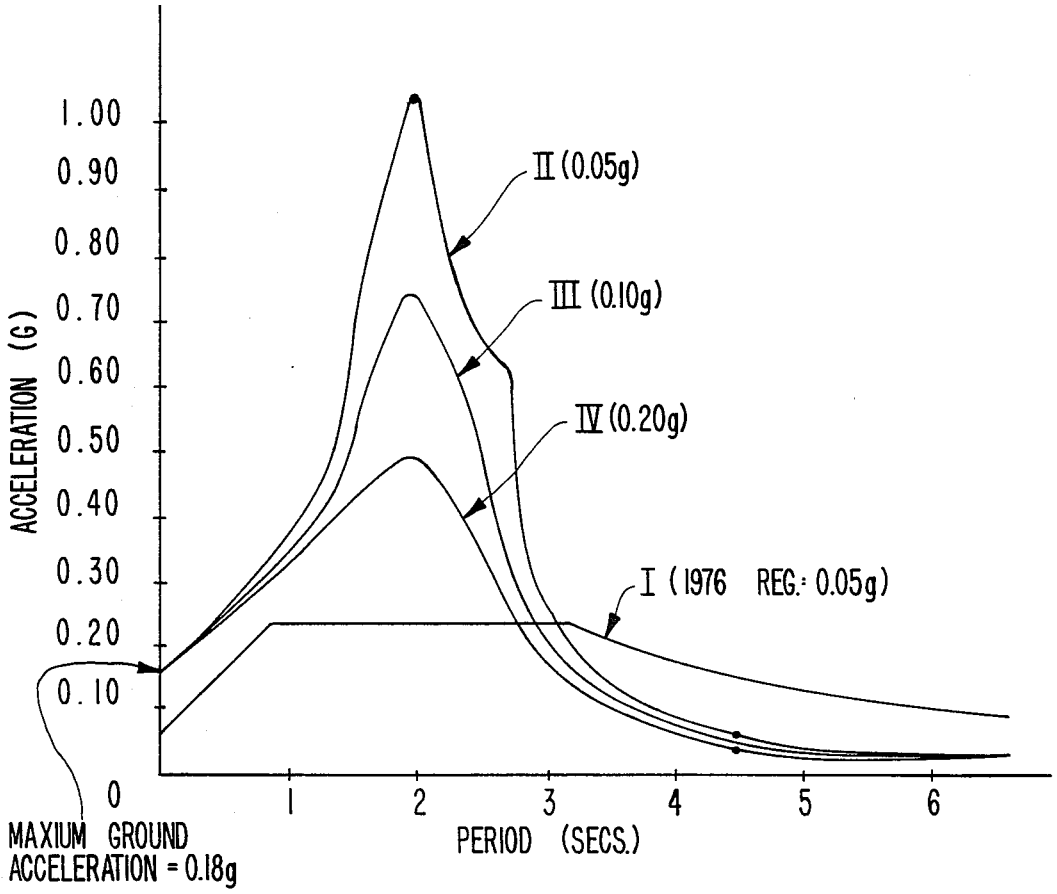
FIG. 16A is a graph of response spectra of an earthquake that occurred in Mexico City on Sept. 19, 1985 and of a Regulation Spectrum for that city.
Figure 16B:
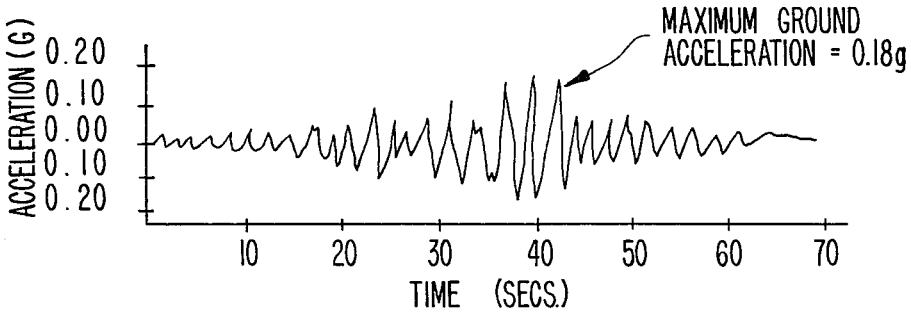
FIG. 16B is a graph of the ground acceleration spectrum for the land on which a building collapsed as a result of that earthquake, serving to illustrate the effects of forces generated by a seismic disturbance.

As before-noted, in areas subject to serious seismic disturbances, seismographic records of several earthquakes in a particular city are analyzed and an official Regulation Spectrum is prepared, setting standards used in building design. FIG. 16A is a Response Spectrum graph, the coordinate of which represents the maximum response of acceleration, speed or displacement, as applicable and either, absolute or relative with regard to the soil, of a pendulum or of a mass held by an elastic element, and the abscissa of which represents the natural period of oscillation, T. In FIG. 16A, graph I is the 1976 Regulation Spectrum for Mexico City, and graphs II, III and IV are plots of the acceleration spectra for damping values of 5%, 10% and 20%, respectively, for the land where a building was located which was reported to have had a fundamental period of oscillation of T=2 seconds, and which collapsed in an earthquake that occurred in Mexico City on Sept. 19, 1985. The spectra of graphs II, III and IV were prepared on the basis of the accelerogram shown in FIG. 16B, as recorded by the Secretary of Communications and Transportation for Mexico which shows that the earthquake had a maximum ground acceleration of 0.18 g. Based on this actual data, it can be seen from FIG. 16A that the building experienced a horizontal acceleration which exceeded 100% g.

In analyzing the application of the invention hereof to that circumstance, had the building been equipped with the base suspension subsystem of the invention, employing cables having a free suspension length of 4.00 meters, the fundamental period of oscillation would have been increased to T=4.5 seconds. From FIG. 16A, the acceleration would not have exceeded 6% (0.06) g, even with only 5% damping as required by the Regulation Spectrum. By using the damping subsystem of the invention, which can easily afford 10% damping (graph III), 20% damping (graph IV) or greater, even smaller values of acceleration would have been experienced.

The many features and advantages of the invention are apparent from the detailed specification and thus it is intended by the appended claims to cover all such features and advantages of the invention which fall within the true spirit and scope thereof. Further, since numerous modifications and changes will readily occur to those skilled in the art, it is not desired to limit the invention to the exact construction and operation illustrated and described and accordingly all suitable modifications and equivalents may be resorted to, falling within the scope of the invention.

I claim:

1. A structure stabilization system for protecting a structure from effects of seismic disturbances, the structure having at least a first floor and plural vertical support columns supporting the weight of the structure and its contents, each vertical support column having upper and lower ends and being attached to the structure with the lower ends extending below the first floor, and an associated foundation formed in the earth, comprising:

a base isolation system comprising plural bases anchored to the foundation and respectively corresponding to the plural vertical support columns, each base being connected to the lower end of a corresponding vertical support column and supporting same in suspension while affording limited, relative movement therebetween to limit the transmission to the structure of movement of the earth and foundation resultant from a seismic disturbance;

a releasable interlock subsystem comprising a single interlock mechanism anchored to the foundation and normally interlocked with the structure at a single, central interlock position thereby to inhibit horizontal translational movement of the structure relative to the foundation and an automatic release mechanism automatically operative, in response to forces exceeding a predetermined level an tending to produce relative linear displacement of the structure and the associated foundation as a result of movement of the earth and the foundation during a seismic disturbances, to release the interlock mechanism thereby to permit relative displacement of the structure and its foundation; and a damping subsystem comprising plural dampers connected at predetermined positions between the structure and the foundation and arranged as orthogonally related pairs of oppositely disposed dampers, relative to the center of gravity of the structure, the associated dampers of each pair being hydraulically interconnected and respectively, mechanically connected between the structure and its associated foundation in inverse relationship thereby to impede rotation of the structure relatively to the foundation and permit only damped relative lateral displacement therebetween.

2. A structure stabilization system as recited in claim 1, wherein the base isolation system further comprises:

plural flexible suspending elements, each having upper and lower ends, associated with each base and affixed at the lower ends thereof to the lower end of the associated support column; and plural adjustable support mechanisms on each base affixed to the upper ends of the respective, plural suspending elements and selectively operable to raise and lower the associated suspending elements for adjusting the actual suspending length of each suspending element for establishing identical elevations of the respective vertical support columns.

3. A structure stabilization system as recited in claim 2, wherein the base isolation system further comprises:

means for adjusting the effective free suspending length of the suspending elements to substantially identical free suspending lengths, independently of the actual suspending lengths thereof, for establishing substantially identical harmonic characteristics of all such suspending elements for all bases.

4. A structure stabilization system as recited in claim 3, wherein the means for adjusting the effective free suspending lengths of the suspending elements further comprises:

plural gripping mechanisms, each selectively and axially positionable on a corresponding vertical support column adjacent the lower end thereof and secured to the vertical support column at a selected axial position, and each having a plurality of clamps extending laterally therefrom and respectively corresponding to and releasably clamping the corresponding suspending elements at positions intermediate the upper and lower ends thereof, the plural gripping mechanisms establishing the effective free suspending length of the suspending elements, between the corresponding adjustable support mechanism and the clamps of the gripper mechanism, and being set at selected axial positions to establish substantially identical effective, free lengths and thereby substantially identical harmonic characteristics of all suspending elements for all bases.

5. A structure stabilization system as recited in claim 1, wherein the single interlock mechanism further comprises:

a rigid plate integrally formed in a central portion of the first floor of the structure and having a central recess therein;

a housing having a vertically disposed channel therein;

a housing support anchored to the foundation and rigidly positioning the housing closely adjacent the central recess in the plate;

an elongated pin having a head defining the upper end of the pin with a configuration mating that of the recess in the plate and an elongated shank portion extending downwardly from the head and received in the housing channel for vertical reciprocating directions of movement therewithin between a raised position with the head received in the recess in the plate to interlock the structure with the foundation and inhibit horizontal translational movement therebetween and a second position removed from the recess and plate;

a bar having first and second ends; and a bracket secured to the first floor and supporting the bar for relative lateral movement of the bar between a first position with the first end of the bar engaging the pin and thereby maintaining the pin in the raised position and a second position withdrawn from the pin.

6. A structure stabilization system as recited in claim 5, wherein:

the automatic release mechanism is connected to the bar and is responsive to a force exceeding the predetermined level to automatically withdraw the bar from the pin, thereby to permit the pin to drop vertically downwardly by gravity from the interlocked position and release the structure.

7. A system as recited in claim 6, wherein:

the head of the pin defines an underlying lip, relatively to the shank portion thereof, of dimensions greater than the channel in the housing, the lip abutting the housing and thereby stopping the vertical downward movement of the pin and supporting the pin.

8. A system as recited in claim 5, wherein:

the pin comprises a shear pin susceptible to being sheared by a force exceeding a second predetermined level greater than the predetermined level of response of the automatic release mechanism.

9. A system as recited in claim 1, wherein the automatic release mechanism further comprises:

a mass;

a pendulum arm having upper and lower ends and a central, pivotal mounting connection, the mass being connected to the lower end;

a pivotal support affixed to the floor of the structure and receiving the pivotal mounting connector of the pendulum arm and thereby supporting the pendulum arm and mass while permitting pivotal movement thereof; and a differential mechanism affixed to the floor and connected to the upper end of the pendulum arm and to the bar and responsive to movement of the mass in an amount corresponding to a force in excess of the predetermined level for producing a withdrawing force on the bar and withdrawing same from the first position thereof engaging the pin.

10. A system as recited in claim 1, wherein:

the plural dampers of the damping subsystem are oriented in a horizontal plane and oppose horizontally oriented forces tending to rotate the structure in a horizontal plane relatively to the foundation.

11. A structure stabilization system as recited in claim 1, wherein the damping subsystem further comprises:

first and second orthogonally oriented pairs of dampers, each damper having therein an internal chamber and a piston movable within the chamber and defining first and second sub-chambers; and first and second hydraulic conduits respectively interconnecting the first and second sub-chambers of each damper.

12. A system as recited in claim 1, wherein the damper subsystem further comprises:

first and second sets of plural dampers, each set comprising respective, orthogonally related pairs of dampers, the associated dampers of each pair of each set being hydraulically interconnected and mechanically connected between the structure and its associated foundation in inverse relationship and the correspondingly disposed, aligned dampers of the first and second sets being mechanically connected between the structure and its associated foundation in inverse relationship.

13. A base isolation system for protecting a structure from the effects of seismic disturbances, the structure having at least a first floor and plural vertical support columns supporting the weight of the structure and its contents, each vertical support column having upper and lower ends and being attached to the structure with the lower ends extending below the first floor, and an associated foundation formed in the earth, comprising:

plural bases anchored to the foundation and respectively corresponding to the plural vertical support columns;

plural flexible suspending elements, each having upper and lower ends, associated with each base and affixed at the lower ends thereof to the lower end of the associated support column for supporting same in suspension while affording limited, relative movement between the associated column and base thereby to limit the transmission to the structure of movement of the earth and foundation resultant from a seismic disturbance;

plural adjustable support mechanisms on each base affixed to the upper ends of the respective, plural suspending and selectively operable to raise and lower the associated suspending elements for adjusting the actual suspending length of each suspending element for establishing identical elevations of the respective vertical support columns; and plural gripping mechanisms, each selectively and axially positionable on a corresponding vertical support column adjacent the lower end thereof and secured to the vertical support column at a selected axial position, and each having a plurality of clamps extending laterally therefrom and respectively corresponding to and releasably clamping the corresponding suspending elements at positions intermediate the upper and lower ends thereof, the plural gripping mechanisms establishing the effective free suspending length of the suspending elements, between the corresponding adjustable support mechanism and the clamps of the gripper mechanism, and being set at selected axial positions to establish the identical effective, free lengths and thereby identical harmonic characteristics of all suspending elements for all bases.

14. A system for protecting a structure from the effects of seismic disturbances, the structure having at least a first floor and an associated foundation formed in the earth, comprising:

a base isolation system anchored to the foundation and supporting the structure while affording limited, relative movement therebetween thereby to limit the transmission to the structure of movement of the earth and foundation resultant from a seismic disturbance; and a releasable interlock subsystem comprising a single interlock mechanism anchored to the foundation and normally interlocked with the structure at a single, central interlock position thereby to inhibit horizontal translational movement of the structure relative to the foundation and an automatic release mechanism automatically operative, in response to forces exceeding a predetermined level and tending to produce relative linear displacement of the structure and the associated foundation as a result of movement of the earth and the foundation during a seismic disturbance, to release the interlock mechanism thereby to permit relative displacement of the structure and its foundation.

15. A structure stabilization system as recited in claim 14, wherein the single interlock mechanism further comprises:

a rigid plate integrally formed in a central portion of the first floor of the structure and having a central recess therein;

a housing having a vertically disposed channel therein;

a housing support anchored to the foundation and rigidly positioning the housing closely adjacent the central recess in the plate;

an elongated pin having a head defining the upper end of the pin with a configuration mating that of the recess in the plate and an elongated shank portion extending downwardly from the head and received in the housing channel for vertical reciprocating directions of movement therewithin between a raised position with the head received in the recess in the plate to interlock the structure with the foundation and inhibit horizontal translational movement therebetween and a second position removed from the recess and plate;

a bar having first and second ends; and a bracket secured to the first floor and supporting the bar for relative lateral movement of the bar between a first position with the first end of the bar engaging the pin and thereby maintaining the pin in the raised position and a second position withdrawn from the pin.

16. A system as recited in claim 15, wherein:

the automatic release mechanism is connected to the bar and is responsive to a force exceeding the predetermined level to automatically withdraw the bar from the pin, thereby to permit the pin to drop vertically downwardly by gravity from the interlocked position and release the structure.

17. A system as recited in claim 15, wherein:

the head of the pin defines an underlying lip, relatively to the shank portion thereof, of dimensions greater than the channel in the housing, the lip abutting the housing and thereby stopping the vertical downward movement of the pin and supporting the pin.

18. A system as recited in claim 16, wherein the release mechanism further comprises:

a mass;

a pendulum arm having upper and lower ends and a central, pivotal mounting connection, the mass being connected to the lower end;

a pivotal support affixed to the floor of the structure and receiving the pivotal mounting connector of the pendulum arm and thereby supporting the pendulum arm and mass while permitting pivotal movement thereof; and a differential mechanism affixed to the floor and connected to the upper end of the pendulum arm and to the bar and responsive to movement of the mass in an amount corresponding to a force in excess of the predetermined level for producing a withdrawing force on the bar and withdrawing same from the first position thereof engaging the pin.

19. A system as recited in claim 14, further comprising:

a damping subsystem comprising plural dampers connected in symmetrically located positions between the structure and the foundation and arranged as oppositely disposed pairs, the associated dampers of each pair being hydraulically interconnected and mechanically connected between the structure and its associated foundation in inverse relationship.

20. A system as recited in claim 14, wherein:

the plural dampers of the damping subsystem are oriented in a horizontal plane and oppose horizontally oriented forces tending to rotate the structure in a horizontal plane relatively to the foundation.

21. A structure stabilization system as recited in claim 19, wherein the damping subsystem further comprises:

first and second orthogonally oriented pairs of dampers, each damper having therein an internal chamber and a piston movable within the chamber and defining first and second sub-chambers; and first and second hydraulic conduits respectively interconnecting the first and second sub-chambers of each damper.

22. A system as recited in claim 19, wherein the damper subsystem further comprises:

first and second sets of plural dampers, each set comprising respective, orthogonally related pairs of dampers, the associated dampers of each pair of each set being hydraulically interconnected and mechanically connected between the structure and its associated foundation in inverse relationship and the correspondingly disposed, aligned dampers of the first and second sets being mechanically connected between the structure and its associated foundation in inverse relationship.

23. A system for protecting a structure from the effects of seismic disturbances, the structure having an associated foundation formed in the earth, comprising:

a base isolation system anchored to the foundation and supporting the structure while affording limited, relative movement therebetween thereby to limit the transmission to the structure of movement of the earth and foundation resultant from a seismic disturbance; and a damping subsystem comprising plural dampers connected in symmetrically located positions between the structure and the foundation and arranged as orthogonally related pairs of associated, oppositely disposed dampers, the associated dampers of each pair being hydraulically interconnected and respectively, mechanically connected between the structure and its associated foundation in inverse relationship thereby to impede rotation of the structure relatively to the foundation and permit only damped relative lateral displacement therebetween.

24. A system as recited in claim 23, wherein:

the plural dampers of the damping subsystem are oriented in a horizontal plane and oppose horizontally oriented forces tending to rotate the structure in a horizontal plane relatively to the foundation.

25. A system as recited in claim 23, wherein:

the plural dampers of the damping subsystem are oriented in a vertical plane and oppose vertically oriented forces tending to rotate the structure in a vertical plane relatively to the foundation.

26. A structure stabilization system as recited in claim 23, wherein the damping subsystem further comprises:

first and second orthogonally oriented pairs of dampers, each damper having therein an internal chamber and a piston movable within the chamber and defining first and second sub-chambers; and first and second hydraulic conduits respectively interconnecting the first and second sub-chambers of the associated dampers of each pair.

27. A system as recited in claim 23, wherein the damper sub-system further comprises:

first and second sets of plural dampers, each set comprising respective, orthogonally related pairs of associated, oppositely disposed dampers, the associated dampers of each pair of each set being hydraulically interconnected and respectively, mechanically connected between the structure and its associated foundation in inverse relationship and the correspondingly disposed, aligned dampers of the first and second sets being mechanically connected between the structure and its associated foundation in inverse relationship thereby to impede rotation of the structure relatively to the foundation and permit only damped, relative lateral displacement therebetween.

28. A system as recited in claim 23, wherein:

each damper comprises a housing defining an interior chamber, a piston received within and movable in sealed relationship within the chamber in opposite axial directions and a piston rod connected to the piston and extending axially outwardly of the chamber, hydraulic fluid within the chamber and a hydraulic connection extending through a wall of the housing and communicating with the chamber.

29. A system as recited in claim 28, wherein:

the dampers of each pair thereof are mechanically connected between the structure and its associated foundation in parallel axis relationship and commonly oriented, the housing of one damper of the pair being connected to the foundation and the piston thereof to the structure, and the housing of the other damper of the pair being connected to the structure and the piston thereof to the foundation, to afford the inverse relationship.

30. A system as recited in claim 29, further comprising:

a hydraulic line extending between the dampers of a given pair thereof and connected at its opposite ends to the respective hydraulic connections thereof for hydraulically interconnecting the associated dampers of each pair, the housings and interconnecting hydraulic line of each damper pair being secured to the foundation.

31. A system as recited in claim 28, wherein:

the dampers of each pair thereof are mechanically connected between the structure and its associated foundation in parallel axis relationship and oppositely oriented, the respective housings of the dampers being connected to the structure and the respective pistons thereof to the associated foundation, to afford the inverse relationship.

32. A system as recited in claim 31, further comprising:

a hydraulic line extending between the dampers of a given pair thereof and connected at its opposite ends to the respective hydraulic connections thereof for hydraulically interconnecting the associated dampers of each pair, the housings and interconnecting hydraulic line of each damper pair being secured to the structure for movement therewith.

33. A system as recited in claim 28, further comprising:

means associated with each hydraulic line for controlling the flow of fluid therethrough in response to movement of a piston within the chamber of an associated damper, produced by relative movement of the structure and foundation, thereby to control the extent of damping afforded by the damping subsystem.

34. A system as recited in claim 28, further comprising:

a hydraulic line extending between the dampers of a given pair thereof and connected at its opposite ends to the respective hydraulic connections thereof for hydraulically interconnecting the associated dampers of each pair; and noncompressible structural elements disposed within the hydraulic line and displacing a corresponding volume of hydraulic fluid thereby to reduce the volume of hydraulic fluid while maintaining fluid communication between the respective chambers of the associated dampers.

* * * * *

UNITED STATES PATENT AND TRADEMARK OFFICE

CERTIFICATE OF CORRECTION

PATENT NO. : 4,860,507

DATED : August 29, 1989

INVENTOR(S) : Federico GARZA-TAMEZ

It is certified that error appears in the above-identified patent and that said Letters Patent is hereby corrected as shown below:

Col. 5, line 58, before "portion" insert --a--;

line 61, before "base" insert --the--.

Col. 6, line 64, change "comprise" to --comprises--.

Col. 7, lines 53 and 60, change "stub 62" to --stud 62--.

Col. 8, line 3, change "stub 62" to --stud 62--.

Col. 9, line 30, change "("l")" to --("ℓ")--; and change "$\overline{/l/g}$)" to --$\sqrt{\ell/g}$)--;

line 32, change "T2" to --$T_2$--;

line 41, change "("l")" to --("ℓ")--.

Col. 10, line 20, change "872,116" to --872,117--.

Col. 11, lines 30, 31, 33 and 34, change "chamber" to --sub-chamber--.

Col. 12, lines 31, 32 and 33, change "chamber" to --sub-chamber--.

UNITED STATES PATENT AND TRADEMARK OFFICE

CERTIFICATE OF CORRECTION

PATENT NO. : 4,860,507

DATED : August 29, 1989

INVENTOR(S) : Federico GARZA-TAMEZ

It is certified that error appears in the above-identified patent and that said Letters Patent is hereby corrected as shown below:

Col. 14, lines 12 and 13, change "chambers" to --sub-chambers--;

line 19, change "chambers 34a-1' and 32a-1'" to --sub-chambers 34A-1' and 32A-1'--.

Col. 15, line 45, change "chamber" to --sub-chamber--;

line 61, change "21a" to --21A--;

line 62, change "21b" to --21B--;

line 63, change "21c" to --21C--.

Col. 16, line 3, change "21b" to --21B--;

line 15, change "112a" to --112A--; and change "21c" to --21C--;

line 61, change "112b" to --112B--.

Col. 17, line 8, change "134A" to --134a--;

line 11, change "124A" to --124a--.

Col. 18, line 33, change "an" to --and--;

line 37, change "disturbances" to --disturbance--.

UNITED STATES PATENT AND TRADEMARK OFFICE

CERTIFICATE OF CORRECTION

PATENT NO. : 4,860,507

DATED : August 29, 1989

INVENTOR(S) : Federico GARZA-TAMEZ

It is certified that error appears in the above-identified patent and that said Letters Patent is hereby corrected as shown below:

Col. 24, lines 14 and 32, change "axis" to --axial--.

In Fig. 2 of the drawings, the base ring which rests directly on the illustrated segment of floor 3, and to which the lower ends of the generally vertical, support members 50 are attached, should be identified by the reference numeral 52. Further, in Fig. 15B, the redundant reference numeral 132 and related arrow appearing in the lower left quadrant of the figure should be deleted. Further, in Fig. 16A, the labels referring to the respective curves should be changed as follows:

"II (0.05g)" should be --II, $\xi$ = 0.05--;

"III (0.10g)" should be --III, $\xi$ = 0.10--;

"IV (0.20g)" should be --IV, $\xi$ = 0.20--; and

"I (1976 REG.: 0.05g)" to --I, 1976 REG., $\xi$ - 0.05--.

Signed and Sealed this

Thirtieth Day of June, 1992

*Attest:*

DOUGLAS B. COMER

*Attesting Officer*

*Acting Commissioner of Patents and Trademarks*